US008967750B2

(12) United States Patent
Ueshima

(10) Patent No.: US 8,967,750 B2
(45) Date of Patent: Mar. 3, 2015

(54) INKJET RECORDING APPARATUS AND IMAGE RECORDING METHOD

(71) Applicant: FUJIFILM Corporation, Tokyo (JP)

(72) Inventor: Masashi Ueshima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 43 days.

(21) Appl. No.: 13/772,033

(22) Filed: Feb. 20, 2013

(65) Prior Publication Data

US 2013/0215178 A1 Aug. 22, 2013

(30) Foreign Application Priority Data

Feb. 22, 2012 (JP) ..... 2012-036455

(51) Int. Cl.
*B41J 29/38* (2006.01)
*B41J 2/12* (2006.01)
*B41J 2/21* (2006.01)

(52) U.S. Cl.
CPC . *B41J 2/12* (2013.01); *B41J 2/2139* (2013.01)
USPC ..... 347/14; 347/19

(58) Field of Classification Search
CPC .... B41J 2/0458; B41J 2/04563; B41J 29/393; B41J 2/04591; B41J 2/04581
USPC ..... 347/14, 19
See application file for complete search history.

(56) References Cited

U.S. PATENT DOCUMENTS

2006/0244774 A1* 11/2006 Arazaki et al. ..... 347/19
2008/0238966 A1 10/2008 Nishihara
2011/0234673 A1 9/2011 Ueshima

FOREIGN PATENT DOCUMENTS

JP 2005-074956 A 3/2005
JP 2006-051617 A 2/2006
JP 2006-247918 A 9/2006
JP 2011-056868 A 3/2011
JP 2011-201121 A 10/2011

OTHER PUBLICATIONS

An Office Action; "Notification of Reasons for Rejection," issued by the Japanese Patent Office on Dec. 16, 2013, which corresponds to Japanese Patent Application No. 2012-036455 and is related to U.S. Appl. No. 13/772,033; with partial translation.

* cited by examiner

*Primary Examiner* — Manish S Shah
*Assistant Examiner* — Yaovi Ameh
(74) *Attorney, Agent, or Firm* — Studebaker & Brackett PC

(57) ABSTRACT

According to the inkjet recording apparatus and the image recording method of the present invention, since the droplet volume of droplets ejected from ejection abnormality nozzles is limited to not greater than a prescribed upper limit value, and the droplet volume of droplets ejected from other normally functioning nozzles is corrected on the basis of correction values used for correction of non-uniformities in the image caused by ejection abnormality nozzles, then in even in cases where the interval between droplets ejected from adjacent nozzles which are adjacent to an ejection abnormality nozzle becomes larger due to landing interference, in particular, it is possible to perform image recording by using droplets ejected from deflecting nozzles. As a result of this, the occurrence of non-uniformities (stripe non-uniformities) in the image can be suppressed.

8 Claims, 22 Drawing Sheets

FIG.6

60

DEFLECTION NOZZLE CORRECTION DATA

61

| OUTPUT DENSITY LIMIT LUT GROUP | | |
|---|---|---|
| AMOUNT OF LANDING POSITION DISPLACEMENT | OUTPUT DENSITY LIMIT LUT | |
| X1 | LUT1 | 61a |
| X2 | LUT2 | 61a |
| X3 | LUT3 | 61a |
| ⋮ | ⋮ | |

62

| EJECTION CORRECTION LUT GROUP | | | |
|---|---|---|---|
| AMOUNT OF LANDING POSITION DISPLACEMENT | DEFLECTING NOZZLE OUTPUT DENSITY | EJECTION CORRECTION LUT | |
| X1 | P1 | LUT1 | 62a |
| X1 | P2 | LUT2 | 62a |
| ⋮ | ⋮ | ⋮ | |
| X2 | P1 | LUT3 | 62a |
| X2 | P2 | LUT4 | 62a |
| ⋮ | ⋮ | ⋮ | |
| X3 | P1 | LUT5 | 62a |
| ⋮ | ⋮ | ⋮ | |

INKJET RECORDING APPARATUS AND IMAGE RECORDING METHOD

BACKGROUND OF THE INVENTION

1. Field of the Invention

The present invention relates to an inkjet recording apparatus and an image recording method which correct image non-uniformities caused by nozzles having an ejection abnormality.

2. Description of the Related Art

An inkjet recording apparatus is known which forms an image on a recording medium by ejecting ink (droplets) from a plurality of ink ejection nozzles (hereinafter, simply called nozzles) of an inkjet head. The plurality of nozzles in an inkjet head may include ejection abnormality nozzles in which an ejection abnormality has occurred, for example, deflecting nozzles in which deflection of the flight of ink has occurred.

As shown in FIG. 20A, if ink has been ejected from a deflecting nozzle N(E), then deviation (error) in the landing position of the ink on the recording medium occurs. As a result of this, as shown in FIG. 20B, when the recording image is observed, a single stripe non-uniformity (a white stripe WL or a black stripe WK) occurs as a result of the deflecting nozzle N(E). Therefore, technology for preventing non-uniformities in a recorded image caused by a deflecting nozzle N(E) have been proposed.

Japanese Patent Application Publication No. 2011-201121 discloses an inkjet recording apparatus which performs correction of a single-stripe non-uniformity (simply called a "stripe non-uniformity" below) by disabling ejection of abnormal nozzles of various kinds, including deflecting nozzles N(E), and also increasing an ink output density of adjacent nozzles which are adjacent to an abnormal nozzle. The inkjet recording apparatus according to Japanese Patent Application Publication No. 2011-201121 performs correction of a stripe non-uniformity by using a correction coefficient (correction parameter) for stripe non-uniformity correction corresponding to differences in a landing interference pattern.

SUMMARY OF THE INVENTION

However, as shown in FIG. 21A, even if deflecting nozzles N(E) are disabled for ejection and the ink output density of adjacent nozzles N(A) is increased, there are still cases where correction of a stripe non-uniformity cannot be performed, as shown in FIG. 21B. Even in the case of an inkjet recording apparatus which is capable of selectively ejecting ink of various droplet sizes, for example, when an ink (dot) of the maximum size is ejected, unless this ink dot is of sufficient size, an ejection failure portion cannot be covered completely, and therefore it is not possible to correct a stripe non-uniformity completely.

In particular, as shown in FIG. 22A, if the ejection of ink from adjacent nozzles comes after ejection of ink from nozzles which are adjacent further to the outer side of the adjacent nozzles, then the ink ejected from the adjacent nozzles is drawn towards the outer side due to landing interference. As a result of this, as shown in FIG. 22B, the interval W between the ejected droplets produced by the adjacent nozzles becomes larger, and a situation arises in which an ejection failure portion cannot be corrected completely. Furthermore, even if ejection of ink droplets having a sufficient dot size for correction is possible, if the droplet volume of the ink is too large, then there is a problem in that the landing position becomes instable and the correction of stripe non-uniformities becomes instable.

It is an object of the present invention to provide an inkjet recording apparatus and an image recording method for same, whereby image non-uniformities caused by ejection abnormality nozzles, such as deflecting nozzles, can be corrected.

In order to achieve the above object, an inkjet recording apparatus according to the present invention includes: a recording head having a plurality of nozzles which perform ejection of droplets; an abnormal nozzle detection device which detects an ejection abnormality nozzle displaying an ejection abnormality, of the plurality of nozzles; a storage device which stores a correction value which is used in correcting a non-uniformity in an image caused by the ejection abnormality nozzle; a droplet volume limiting device which limits a droplet volume of droplets ejected from the ejection abnormality nozzle detected by the abnormal nozzle detection device, to not greater than a prescribed upper limit value which is smaller than the droplet volume of the droplets ejected from other normally functioning nozzles apart from the ejection abnormality nozzle; a droplet volume correction device which corrects a droplet volume of the droplets ejected from normally functioning nozzles, on the basis of the correction value stored in the storage device; and an image recording device which records an image on a recording medium by depositing droplets ejected respectively from the ejection abnormality nozzle and normally functioning nozzles of the recording head, onto the recording medium, while relatively moving the recording head and the recording medium.

According to the present invention, since recording is carried out in a state where the ink droplet volume ejected from ejection abnormality nozzles is limited, rather than disabling ejection from ejection abnormality nozzles, then the occurrence of non-uniformities (stripe non-uniformities) in the image is suppressed, and the amount of droplets (ink) used for correcting the non-uniformity is also reduced.

It is preferable that the droplet volume correction device increases a droplet volume of the droplets ejected from the normally functioning nozzles which record dots adjacent to the dots corresponding to the ejection abnormality nozzles. According to the aspect, it is possible to correct stripe non-uniformities caused by the ejection abnormality nozzles.

It is preferable that the ejection abnormality nozzle is a deflecting nozzle which produces deflection of the flight of the droplets, and that the inkjet recording apparatus further includes a displacement amount determination device which determines an amount of displacement of a landing position of the liquid droplet ejected onto the recording medium from the deflecting nozzle, and wherein the droplet volume limiting device modifies the upper limit value in accordance with a size of the amount of displacement determined by the displacement amount determination device. According to the aspect, since appropriate upper limit value is set in accordance with a size of the amount of displacement, non-uniformities (stripe non-uniformities) in the image are more steadily suppressed, thus an image with good quality is obtained.

It is preferable that the droplet volume correction device modifies the correction amount of the droplet volume of the droplets ejected from the normally functioning nozzles, in accordance with the size of the amount of displacement determined by the displacement amount determination device. According to the aspect, since optimum correction amount is set in accordance with the size of the amount of displacement, non-uniformities (stripe non-uniformities) in the image are more steadily suppressed, thus an image with good quality is obtained. In addition, the amount of droplets (ink) used for correcting the non-uniformity is reduced.

It is preferable that the droplet volume limiting device limits the droplet volume of the droplets ejected from the ejection abnormality nozzles, by implementing image processing to image data. According to the aspect, recording is carried out in a state where the droplet volume of the droplets (ink) ejected from ejection abnormality nozzles is limited, rather than disabling ejection from ejection abnormality nozzles.

It is preferable that the plurality of nozzles are capable of selectively ejecting the droplets of a plurality of types having different droplet sizes; and the droplet volume limiting device causes the droplets of the droplet size corresponding to a droplet volume not greater than the upper limit value, to be ejected from the ejection abnormality nozzle. According to the aspect, recording is carried out in a state where the droplet volume of the droplets (ink) ejected from ejection abnormality nozzles is limited, rather than disabling ejection from ejection abnormality nozzles.

It is preferable that the droplet volume limiting device causes the droplets having a smallest droplet size to be ejected from the ejection abnormality nozzle. According to the aspect, recording is carried out in a state where the droplet volume of the droplets (ink) ejected from ejection abnormality nozzles is limited, rather than disabling ejection from ejection abnormality nozzles.

It is preferable that the inkjet recording apparatus further includes a head driver which sends drive signals respectively to the plurality of nozzles, wherein the droplet volume limiting device limits a droplet volume of the droplets ejected from the ejection abnormality nozzle to not greater than the upper limit value, by controlling the head driver so as to adjust the drive signal sent to the ejection abnormality nozzle. According to the aspect, recording is carried out in a state where the droplet volume of the droplets (ink) ejected from ejection abnormality nozzles is limited, rather than disabling ejection from ejection abnormality nozzles.

It is preferable that the abnormal nozzle detection device carries out detection of the ejection abnormality nozzle, on the basis of reading results of a test chart constituted by line patterns recorded respectively by each of the plurality of nozzles. According to the aspect, it is possible to determine whether a nozzle is an ejection abnormality nozzle or not for each of the plurality of nozzles.

It is preferable that the recording head is a head based on a single-pass method which records the image by one relative movement of the head with respect to the recording medium. The aspect is preferable because in a single-pass method, recording is carried out by only one relative movement, and thus non-uniformities (stripe non-uniformities) in the image must surely be corrected in the one relative movement.

In order to achieve the above object, an image recording method executed by an inkjet recording apparatus according to the present invention includes: an abnormal nozzle detection step of detecting an ejection abnormality nozzle displaying an ejection abnormality, from a recording head having a plurality of nozzles which perform ejection of droplets; a droplet volume limiting step of limiting a droplet volume of the droplets ejected from the ejection abnormality nozzle detected in the abnormal nozzle detection step, to not greater than a prescribed upper limit value which is smaller than the droplet volume of the droplets ejected from other normally functioning nozzles apart from the ejection abnormality nozzle; a droplet volume correcting step of correcting a droplet volume of the droplets ejected from the normally functioning nozzles, on the basis of a previously stored correction value used for correction of a non-uniformity in an image caused by the ejection abnormality nozzle; and an image recording step of recording an image on a recording medium by depositing droplets ejected respectively from the ejection abnormality nozzle and the normally functioning nozzles of the recording head, onto the recording medium, while relatively moving the recording head and the recording medium.

According to the method of the present invention, since recording is carried out in a state where the ink droplet volume ejected from ejection abnormality nozzles is limited, rather than disabling ejection from ejection abnormality nozzles, then the occurrence of non-uniformities (stripe non-uniformities) in the image is suppressed, and the amount of droplets (ink) used for correcting the non-uniformity is also reduced.

According to the inkjet recording apparatus and the image recording method of the present invention, since the droplet volume of droplets ejected from ejection abnormality nozzles is limited to not greater than a prescribed upper limit value, and the droplet volume of droplets ejected from other normally functioning nozzles is corrected on the basis of correction values used for correction of non-uniformities in the image caused by ejection abnormality nozzles, then in even in cases where the interval between droplets ejected from adjacent nozzles which are adjacent to an ejection abnormality nozzle becomes larger due to landing interference, in particular, it is possible to perform image recording by using droplets ejected from deflecting nozzles. As a result of this, the occurrence of non-uniformities (stripe non-uniformities) in the image can be suppressed.

Furthermore, by ejecting droplets from the ejection abnormality nozzles, it is possible to reduce the volume of droplets which are used in the correction of image non-uniformities (droplets which are ejected from adjacent nozzles that are adjacent to an ejection abnormality nozzle). Consequently, the occurrence of problems such as destabilization of the landing positions due to the ink droplet volume ejected from the adjacent nozzles becoming too large, is prevented.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 6 is a schematic drawing of deflecting nozzle correction data;

DESCRIPTION OF THE PREFERRED EMBODIMENTS

[General Composition of Inkjet Printing System According to First Embodiment]

Figure 1:
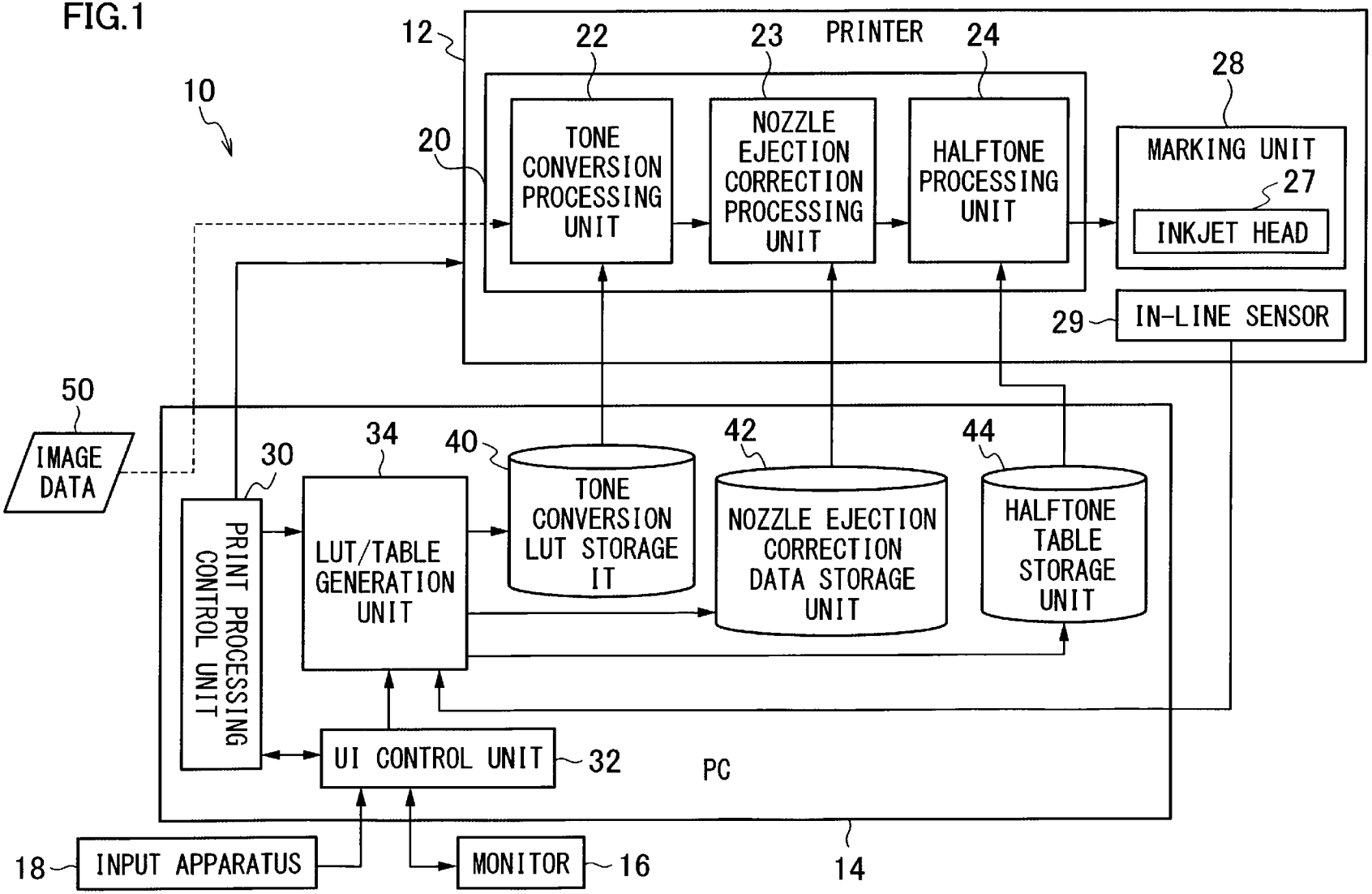
FIG. 1 is a block diagram showing an electrical composition of an inkjet printing system according to a first embodiment.

FIG. 1 is a block diagram showing an example of the composition of an inkjet printing system (an inkjet recording apparatus, which is simply called a printing system below) 10 relating to a first embodiment of the present invention. The printing system 10 is a system which records an image by a single pass method, using an inkjet head that corresponds to the recording head according to the present invention. More specifically, the printing system 10 forms an image of a prescribed recording resolution (for example, 1200 dpi) on an image forming region of the recording medium, simply by performing one operation of relatively moving a recording medium with respect to an inkjet head (performance of one sub-scanning operation). A case is described here, in which inks of four colors, cyan (C), magenta (M), yellow (Y) and black (K) are used in the printing system 10, and inkjet heads are provided for each respective color, as devices for ejecting the inks of the respective colors. However, the combination of ink colors and the number of colors are not limited to those of the present embodiment.

The inkjet printing system 10 is constituted by a printer 12, a computer main body (hereinafter, called "PC") 14, a monitor 16 and an input apparatus 18.

The PC 14 is connected to the printer 12. The PC 14 functions as a control apparatus which controls operations of the printer 12, and also functions as a data management apparatus which manages data of various types.

The monitor 16 and the input apparatus 18 which form a user interface (UI) are connected to the PC 14. The input apparatus 18 can employ a device of various types, such as a keyboard, a mouse, a touch panel, a tracking ball, and the like, or may use a suitable combination of these. Furthermore, input interfaces of various types for externally inputting data of various types are provided in the input apparatus 18. An operator uses the monitor 16 and the input apparatus 18 to perform operations of the printer 12. When a print instruction is issued by the PC 14, image data 50, such as page data, is sent to the printer 12 and is processed by an image processing circuit (image processing board) 20.

<Composition of Printer According to First Embodiment>

The printer 12 includes: an image processing circuit 20 (various processing units 22, 23, 24) which carries out signal processing for converting image data 50 for printing input via a PC 14 into a marking signal; a marking unit (image recording device) 28 which executes image recording by driving inkjet heads 27 of the specific colors in accordance with the marking signal; and an in-line sensor 29 which reads in a test chart recorded by the marking unit 28, and the like.

While carrying out various processes to generate a marking signal from the image data 50, the image processing circuit 20 carries out tone conversion processing, nozzle ejection correction processing and halftone processing to generate a marking signal. The image processing circuit 20 includes a tone conversion processing unit 22, a nozzle ejection correction processing unit (droplet volume limiting device, droplet volume correction device) 23, and a halftone processing unit 24.

The tone conversion processing unit 22 carries out processing for determining the characteristics of the density tones, such as what density of color to use in image formation, when forming (recording) an image with the marking unit 28. The tone conversion processing unit 22 converts the image data 50 in such a manner that the coloring characteristics specified by the printer 12 are achieved. For example, the tone conversion processing unit 22 converts a CMYK signal to a C'M'Y'K' signal and converts each of the C signal, M signal, Y signal and K signal, color by color, to a C' signal, M' signal, Y' signal and K' signal.

The signal conversion performed by the tone conversion processing unit 22 specifies a conversion relationship by referring to a tone conversion look-up table (LUT) (not illustrated) which is stored in the tone conversion LUT storage unit 40. A plurality of LUTs which are optimized for each type of paper (recording medium) used are stored in the tone conversion LUT storage unit 40, and a suitable LUT is referred to in accordance with the type of paper used. Tone conversion LUTs of this kind are prepared for each color of ink. In the case of the present embodiment, tone conversion LUTs are provided respectively for each color of C, M, Y and K.

When a print execution instruction is input, the tone conversion LUT matching the corresponding print conditions is selected automatically and is set in the tone conversion processing unit 22. Furthermore, by inputting instructions for selecting, modifying and amending an LUT, and so on, via the input apparatus 18, it is possible to set up a desired LUT.

The nozzle ejection correction processing unit 23 is a processing unit for correcting an output density of each nozzle (an ejected ink droplet volume) in the inkjet heads 27, in order to correct non-uniformities in the image recorded on the recording medium. The "image non-uniformity" referred to here is a stripe non-uniformity caused by an abnormal nozzle which is not capable of normal image recording (see FIGS. 20A to 21B).

Furthermore, an "abnormal nozzle" is, for example, an ejection failure nozzle or an ejection abnormality nozzle, or the like. An ejection failure nozzle is a nozzle which cannot eject ink of a normal volume or which cannot eject ink at all, even if a shading correction process for increasing the ink ejection volume is carried out. An ejection abnormality nozzle is a nozzle which produces an ejection abnormality, such as an ejection direction abnormality in which ink is ejected but deflection of the flight of ink occurs, or a droplet volume abnormality in which the volume of the ejected ink droplet becomes larger or smaller. Below, a so-called deflecting nozzle N(E) (see FIG. 10) which produces deflection of the flight of ink is described as an example of an ejection abnormality nozzle.

In order to correct a stripe non-uniformity caused by an abnormal nozzle of this kind (an ejection failure nozzle or a deflecting nozzle), signal conversion of the image signal (image data 50) is carried out, for instance, by the nozzle ejection correction processing unit 23.

More specifically, the nozzle ejection correction processing unit 23 converts the image signal so as to respectively correct the output density (ejected ink droplet volume) of abnormal nozzles (deflecting nozzles) and, in particular, the output density (ejected ink droplet volume) of adjacent nozzles which are adjacent to an abnormal nozzle, of the plurality of nozzles in the inkjet heads 27. Here, the correction of the output density is correction of the droplet volume of the ink which forms one dot of the image, for example, correction of the ink dot diameter or correction of the average droplet volume of the ink ejected from the nozzle.

Furthermore, an "adjacent nozzle" is not limited to a nozzle that is adjacent to the abnormal nozzle, and also includes a nozzle which records a pixel adjacent to a pixel corresponding to an abnormal nozzle, in other words, a nozzle that is not necessarily adjacent to an abnormal nozzle. When the output density of the adjacent nozzles has been corrected, the output density of the nozzles positioned further to the outer side of the adjacent nozzles (on the opposite side from the abnormal nozzles) may also be corrected, according to requirements.

The conversion of the image signal performed by the nozzle ejection correction processing unit 23 involves, for example, converting the CMYK signal to a C"M"Y"K" signal, and converting each of the C' signal, M' signal, Y' signal and K' signal, color by color, to a C" signal, M" signal, Y" signal and K" signal. This conversion processing specifies a conversion relationship by referring to a LUT or other table which is stored in the nozzle ejection correction table storage unit 42 in the PC 14.

The halftone processing unit 24 converts the image signal having multiple tones (for example, 256 tones based on 8 bits per color), in pixel units, into a binary signal which indicates ink ejection or no ink ejection, or into a multiple-value signal indicating what type of droplet to eject, if a plurality of ink diameters (droplet sizes, dot sizes) can be selected. In general, processing is carried out to convert multiple-tone image data having M values (where M is an integer no less than 3) into data having N values (where N is an integer less than M and no less than 2). The halftone processing may employ a dithering method, error diffusion method, density pattern method, or the like.

For example, if the inkjet head 27 can selectively ejects three types of droplet sizes, namely, a large droplet, a medium droplet and a small droplet, then the halftone processing unit 24 converts the multiple-tone data (for example, 256 tones) after nozzle ejection correction processing into a signal of four values, namely: "eject large-droplet ink", "eject medium-droplet ink", "eject small-droplet ink" and "do not eject ink". The signal conversion in the halftone processing unit 24 determines the conversion relationship by referring to a halftone table (not illustrated) which is stored in a halftone table storage unit 44 in the PC 14.

The halftone table is a table which specifies the ratio in which the dots of the respective sizes (large/medium/small) are used per unit surface area, a dot ratio of the respective dot sizes being specified in accordance with the magnitude of the input signal. The halftone table storage unit 44 stores halftone tables of a plurality of types, and one of the tables is selected when printing.

The marking unit 28 has inkjet heads 27 for specific colors as described above, and a relative movement mechanism (see FIG. 16) which causes relative movement of the inkjet heads 27 and a recording medium. A plurality of ink ejection nozzles are arranged through a length corresponding to the maximum width of the image forming region of the recording medium, on an ink ejection surface (nozzle surface) of each inkjet head 27. A high recording resolution can be achieved by a composition in which a plurality of nozzles are arranged in a two-dimensional configuration on the ink ejection surface.

In the case of an inkjet head 27 having a two-dimensional nozzle arrangement, a projected nozzle row in which the nozzles are projected (by orthogonal projection) to an alignment in a direction (corresponding to a "main scanning direction") which is perpendicular to the medium conveyance direction (corresponding to a "sub-scanning direction") can be regarded as equivalent to a single nozzle row in which the nozzles are arranged at roughly even spacing at a nozzle density which achieves the recording resolution in the main scanning direction (the medium width direction). Here, "roughly even spacing" means substantially even spacing between the droplet ejection points which can be recorded by the printing system. For example, the concept of "even spacing" also includes cases where there is slight variation in the intervals, to take account of manufacturing errors or movement of the droplets on the medium due to landing interference. Taking account of the projected nozzle row (also called the "effective nozzle row"), it is possible to associate the nozzle positions (nozzle numbers) in the alignment sequence of the projected nozzles which are aligned following the main scanning direction. In the description given below, reference to "nozzle positions (nozzle numbers)" means the positions (numbers) of the nozzles in the effective nozzle row.

The multiple-value signal generated by the halftone processing unit 24 (in the present embodiment, a four-value marking signal) is sent to the inkjet heads 27 of the marking unit 28 and is used to control driving of ejection energy generating elements (for example, piezoelectric elements or heating elements) of the corresponding nozzles. More specifically, ink ejection from the respective nozzles is controlled in accordance with this four-value signal. A large dot is recorded on the recording medium by large-droplet ink, a medium dot is recorded on the recording medium by medium-droplet ink, and a small dot is recorded on the recording medium by small-droplet ink. In this way, multiple tones are reproduced by surface area tones based on the arrangement of ink dots which are formed on the recording medium.

The in-line sensor 29 reads in various test charts which are formed on the recording medium by the inkjet heads 27, and employs a CCD line sensor, for example. It is also possible to detect the abnormal nozzles and determine the recording characteristics of the nozzles (for example, the recording density, landing position error, and the like), on the basis of the reading results (characteristics information) of the test chart by the in-line sensor 29.

Composition of PC According to First Embodiment

Broadly speaking, the PC 14 includes: a print processing control unit 30, a user interface (UI) control unit 32, a LUT/table generation unit 34, a tone conversion LUT storage unit 40, a nozzle ejection correction data storage unit (storage device) 42 and a halftone table storage unit 44. These respective units are constituted by hardware or software of the PC 14, or by a combination of these.

The print processing control unit 30 controls operation of the printer 12. The print processing control unit 30 controls processing of various kinds in the LUT/table generation unit 34, and the like, as well as controlling the display of the monitor 16 and implementing control in accordance with input instructions from the input apparatus 18, in association with the UI control unit 32.

Furthermore, the print processing control unit 30 issues a test chart creating instruction and a test chart reading instruction to the printer 12. Upon receiving these instructions, the printer 12 creates a test chart, reads in the test chart by the in-line sensor 29, and outputs the reading results to the PC 14.

Figure 2:
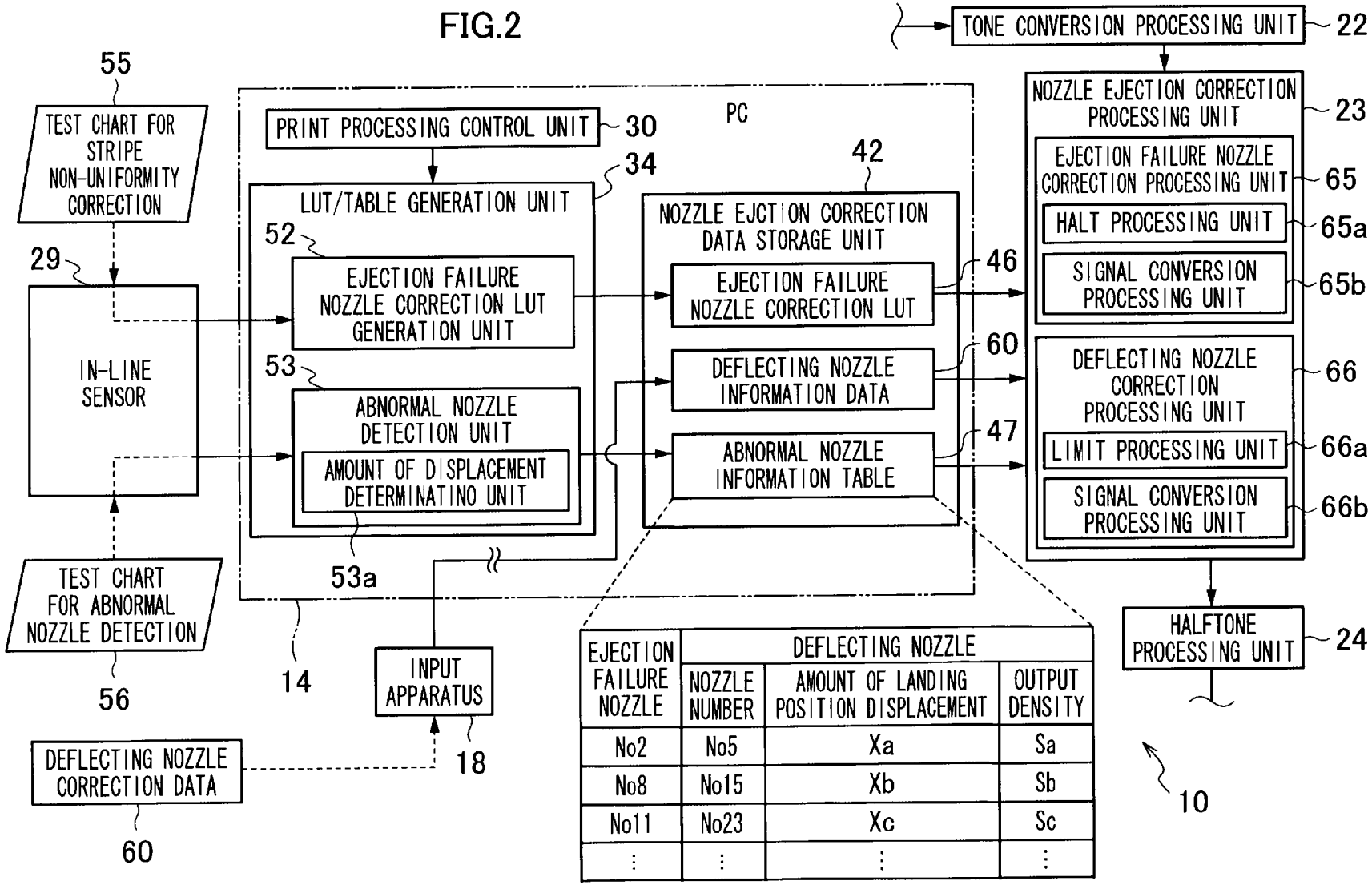
FIG. 2 is a block diagram showing an electrical composition of a PC.

The LUT/table generation unit 34 receives a control signal from the print processing control unit 30 and an instruction signal (operating signal) from the UI control unit 32, and generates image processing parameters for a tone conversion LUT, an ejection failure nozzle correction LUT 46 (see FIG. 2), a halftone table, and the like, and an abnormal nozzle information table 47 (see FIG. 2).

As shown in FIG. 2, the LUT/table generation unit 34 has an ejection failure nozzle correction LUT generation unit 52 and an abnormal nozzle detection unit (abnormal nozzle detection device) 53. The ejection failure nozzle correction LUT generation unit 52 generates an ejection failure nozzle correction LUT 46 used in correction of stripe non-uniformities in an image caused by ejection failure nozzles. The abnormal nozzle detection unit 53 detects abnormal nozzles (ejection failure nozzles, deflecting nozzles).

<Ejection Failure Nozzle Correction LUT Generation Processing>

The ejection failure nozzle correction LUT generation unit 52 generates an ejection failure nozzle correction LUT 46 on the basis of the reading results of a test pattern for stripe non-uniformity correction 55 which is read in by the in-line sensor 29. The ejection failure nozzle correction LUT 46 may be generated at any timing; for example, possible modes are one where the LUT 46 is generated when an ejection failure nozzle correction LUT 46 generation start operation is performed at the input apparatus 18, where the LUT 46 is generated before starting a printing job, where the LUT 46 is generated each time a prescribed time period has elapsed, where the LUT 46 is generated each time a prescribed number of prints has been made, where the LUT 46 is generated when the type or size of the recording medium has changed, and so on. The ejection failure nozzle correction LUT 46 is updated at a suitable timing, as described above, on the basis of the instructions from the print processing control unit 30.

Figure 3A:
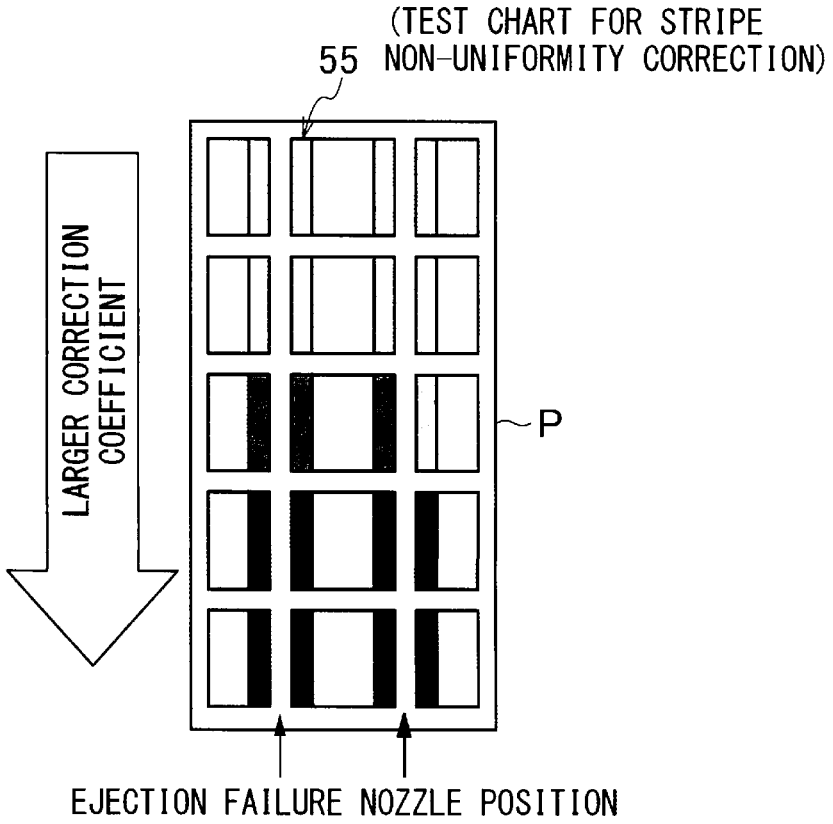
FIG. 3A and FIG. 3B are illustrative diagrams for describing an example of processing for generating an ejection failure nozzle correction LUT.

As shown in FIG. 3A, when generating the test chart for stripe non-uniformity correction 55, ink is not ejected from particular nozzles of the inkjet head 27 (at least one nozzle, and desirably, a plurality of nozzles spaced at suitable intervals apart) (namely, image formation is not performed from particular nozzles). In other words, the pixel value at the image formation position of the particular nozzles (the image setting value which represents the density tone) is set to 0, or an ejection disabling command is applied to the head driver (drive circuit) (not illustrated) of the inkjet head 27. Consequently, particular nozzles are set artificially to an ejection failure status. A nozzle set artificially to an ejection failure status in this way is called an "artificial ejection failure nozzle".

Simultaneously with this, the image setting values of the image formation positions of the adjacent nozzles before and after the artificial ejection failure nozzle are set to values obtained by multiplying a correction coefficient by the basic image setting value corresponding to a solid image of a prescribed density (tone value). A plurality of patches are formed while varying, in stepwise fashion, the correction coefficient applied to the basic image setting value corresponding to a particular density.

In FIG. 3A, in order to simplify the drawings, the correction coefficient is changed in five steps, and five patches corresponding to five different correction coefficients are formed, but there are no particular restrictions on the number of steps in which the correction coefficient is changed. Furthermore, here, only a chart (group of patches) relating to one basic image setting value corresponding to a particular density is depicted, but similar groups of patches are formed for a plurality of basic image setting values of different densities (tone values).

For example, the range of tones from 0 to 255 is divided equally into 32 steps, and 20 patch groups are formed by changing the correction coefficient in 20 steps, for the basic image setting value of each tone (density). In other words, 32×20 patches are created in respect of one artificial ejection failure nozzle. From the viewpoint of raising measurement accuracy (improving measurement reliability), it is desirable to have a plurality of ejection failure nozzles, and similar patch groups are formed in respect of each of the plurality of artificial ejection failure nozzles. Furthermore, the test chart is not limited to a mode where all of the patches are recorded on one sheet of recording medium P, and it is also possible to record these band-shaped patterns over a plurality of sheets of recording media.

Figure 3B:
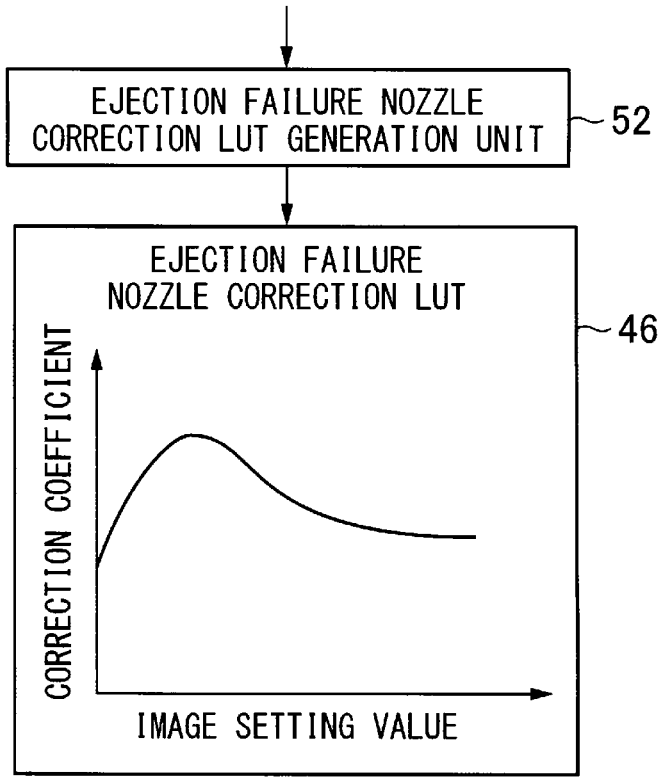

As shown in FIG. 3B, the ejection failure nozzle correction LUT generation unit 52 selects a patch using a correction coefficient which yields the best visual characteristics (the best output quality in which a stripe is not conspicuous), of the plurality of patches formed by varying the correction coefficient in the test chart for stripe non-uniformity correction 55, on the basis of the reading results of the test chart for stripe non-uniformity correction 55 obtained by the in-line sensor 29. In this way, the ejection failure nozzle correction LUT 46 is obtained by selecting the optimal correction coefficient for each basic image setting value. The ejection failure nozzle correction LUT 46 shown in FIG. 3B is one example of an ejection failure nozzle correction LUT.

The horizontal axis of the ejection failure nozzle correction LUT 46 shows an image setting value indicating the instructed solid density (base tone value) when forming the test chart, and the vertical axis indicates the value specified as the correction coefficient which yields the best correction effect. FIGS. 3A and 3B show a smooth continuous graph, but if test charts are created for base tone values in 32 steps in a range from a value of 0 to 255, then discrete data corresponding to these respective values is obtained. Intermediate data is estimated from these discrete data values by means of a common interpolation method. The ejection failure nozzle correction LUT generation unit 52 then stores the ejection failure nozzle correction LUT 46 in the nozzle ejection correction data storage unit 42.

<Abnormal Nozzle Detection Process>

Figure 4A:
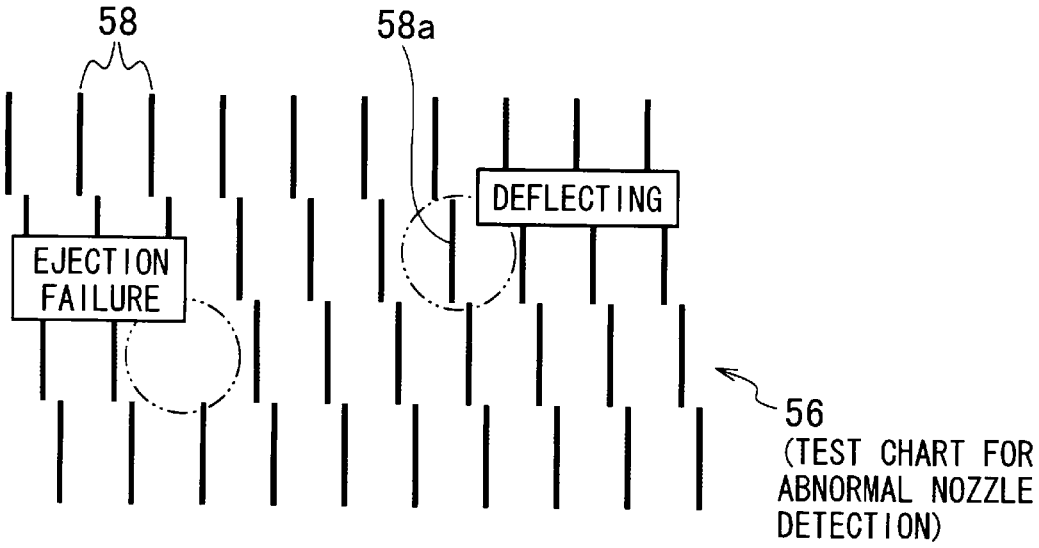
FIG. 4A is a schematic diagram of a test chart for abnormal nozzle detection 56 and FIG. 4B is an enlarged diagram of a line pattern recorded by a deflecting nozzle.
Figure 4B:
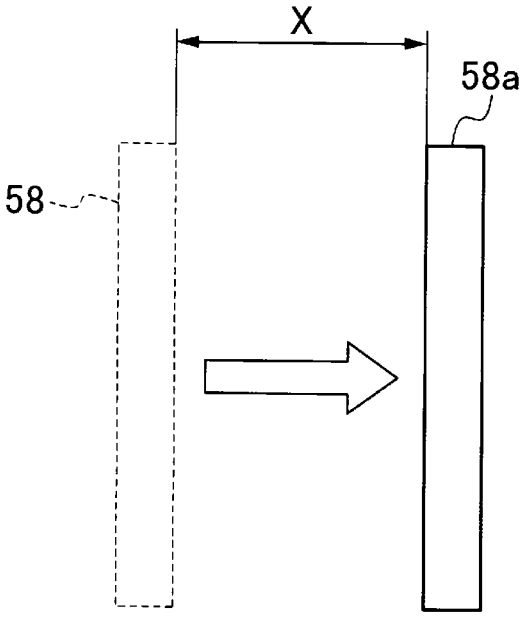

As shown in FIG. 2 and FIGS. 4A and 4B, the abnormal nozzle detection unit 53 detects an abnormal nozzle amongst the nozzles of the inkjet head 27, on the basis of the reading results of the test chart for abnormal nozzle detection (test chart) 56 read by the in-line sensor 29.

Abnormal nozzles may be detected at any timing, similarly to the generation of an ejection failure nozzle correction LUT 46; for example, there is a mode where abnormal nozzles are detected when an abnormal nozzle detection start operation is performed at an input apparatus 18, for example, where abnormal nozzles are detected before the start of a printing job, where abnormal nozzles are detected each time a prescribed time period has elapsed, where abnormal nozzles are detected each time a prescribed number of prints has been made, and so on. The abnormal nozzles are detected at a suitable timing, as described above, on the basis of the instructions from the print processing control unit 30.

When generating the test chart for abnormal nozzle detection 56, a line pattern 58 is recorded on the recording medium P by the nozzles of the inkjet head 27. This test chart for abnormal nozzle detection 56 is a so-called "1-on n-off" type line pattern.

For example, in one line head, nozzle numbers are assigned sequentially, from one end in the main scanning direction, to an alignment of nozzles composed effectively by a single nozzle row alignment along the width direction of the recording medium P (main scanning direction) (an effective nozzle row obtained by orthogonal projection). Nozzle groups which perform ejection simultaneously are classified by the remainder "B" of dividing the nozzle number by an integer "A" which is no less than 2 (B=0, 1, . . . , A-1), and respective line groups are formed by continuous droplet ejection from the nozzles, by altering the droplet ejection timing for each group of nozzle numbers, AN+0, AN+1, . . . , AN+B, (where N is an integer no less than 0). By this means, a 1-on n-off type of line pattern is obtained. By using a test chart for abnormal nozzle detection 56 of this kind, independent line patterns 58 (for each nozzle) are formed in which each nozzle can be distinguished from the others, without any overlapping of the line patterns 58 between adjacent nozzles which are mutually adjacent.

In the test chart for abnormal nozzle detection 56, a line pattern 58 corresponding to an ejection failure nozzle which cannot eject ink at all is missing, as represented by the "ejection failure" indicated within the rectangular frame in FIG. 4A. Furthermore, the line pattern 58 corresponding to the ejection failure nozzle which cannot eject ink of a normal volume (a volume capable of recording an image) has a low density. Therefore, it is possible to specify the position (nozzle number) of an ejection failure nozzle on the basis of whether or not a line pattern 58 is missing or whether or not the density of the line pattern 58 (including the line pattern 58*a* described below) is not less than a prescribed specific value. The density of the line patterns 58 can be determined by using a prescribed calculation formula or a table, on the basis of the width of the line patterns 58, or the like.

Moreover, in the test chart for abnormal nozzle detection 56, the line pattern 58*a* corresponding to the deflecting nozzle N(E) is recorded at a position which is displaced from the original recording position (a recording position where the pattern is recorded in a normal case when no abnormality has occurred), as indicated by "deflected" in the rectangular frame in FIG. 4A. When a deflecting nozzle N(E) has occurred in such a manner that the ink ejection direction varies, then the line pattern corresponding to this deflecting nozzle N(E) is deflected (not shown in the drawings). Therefore, it is possible to specify the position of a deflecting nozzle N(E) from the recording position of the line pattern 58*a*.

Apart from a line pattern of a so-called "1-on, n-off" type described above, the test chart for abnormal nozzle detection 56 of this kind may also include other patterns, such as other line blocks (for example, a block for confirming relative position error between line blocks) or horizontal lines (dividing lines) which divide between the line blocks, and the like. Furthermore, the test chart for abnormal nozzle detection 56 is formed for each inkjet head 27 of different ink colors.

The abnormal nozzle detection unit 53 detects ejection failure nozzles and deflecting nozzles N(E), and the like, by analyzing the test chart for abnormal nozzle detection 56, and records (stores) abnormal nozzle information, such as a nozzle number indicating a position of the abnormal nozzle, in an abnormal nozzle information table 47 of the nozzle ejection correction data storage unit 42. The abnormal nozzle detection unit 53 detects the output density of the deflecting nozzle N(E) when a deflecting nozzle N(E) is detected [the output density being the volume of the ejected ink droplet (the ink droplet volume forming one dot on the image: for example, an ink dot diameter or an average droplet volume of ink ejected from a nozzle, etc.)]. The output density of the deflecting nozzle N(E) can be determined, for example, from the width of the line pattern 58*a* corresponding to the deflecting nozzle N(E) (which may be the average width, the maximum width, the minimum width or the width at a particular location).

Moreover, a displacement amount determination unit (displacement amount determination device) 53*a* is provided in the abnormal nozzle detection unit 53. The displacement amount determination unit 53*a* operates when a deflecting nozzle N(E) has been detected by the abnormal nozzle detection unit 53.

As shown in FIG. 4B, the displacement amount determination unit 53*a* determines an amount of displacement of the landing position of ink ejected from a deflecting nozzle N(E), on the recording medium (below, this amount of displacement is called the amount of landing position displacement), on the basis of an amount of deviation X from the original recording position of the line pattern 58*a* corresponding to the deflecting nozzle N(E) (in FIG. 4B, the original recording position is the line pattern 58 indicated by the dotted line). The amount of displacement X may be determined for each dot which constitutes the line pattern 58*a*, or the amount of landing position displacement may be determined from the maximum value, the minimum value or the average value, or the like. This amount of landing position displacement is a value that is an indicator of the extent of the problem in the deflecting nozzle N(E).

The determination results for the output density of the deflecting nozzle N(E) and the determination results for the amount of landing position displacement by the displacement amount determination unit 53*a* are recorded (stored) in the abnormal nozzle information table 47 in associated fashion with the abnormal nozzle information (nozzle number) of the deflecting nozzle described above (see FIG. 2).

<Acquisition of Deflecting Nozzle Correction Data>

Returning to FIG. 2, apart from the ejection failure nozzle correction LUT 46 and the abnormal nozzle information table 47 described above, deflecting nozzle correction data (correction values) 60 used for correction of stripe non-uniformities in the image caused by deflecting nozzles N(E) is also stored in the nozzle ejection correction data storage unit 42.

The correction of stripe non-uniformities caused by deflecting nozzles is carried out by limiting the output density (ejected ink droplet volume) of the deflecting nozzles N(E) to not greater than a prescribed upper limit value UL (see FIG. 8) which is lower than the output density of the other normally functioning nozzles, and also increasing the output density of the adjacent nozzles N(A) (which correspond to normally functioning nozzles according to the present invention, see FIG. 10) which are adjacent to the deflecting nozzles N(E). This correction differs from the correction of stripe non-uniformities in the image caused by ejection failure nozzles as described above in that an upper limit is placed on the output density, rather than halting ejection of ink from the deflecting nozzles N(E). The deflecting nozzle correction data 60 is generated by an external inspection apparatus, for example, and is then stored in a nozzle ejection correction data storage unit 42 via an input interface of the input apparatus 18, for example. The normally functioning nozzles referred to here are nozzles in which no abnormality, such as an ejection abnormality or ejection failure abnormality, has occurred.

Figure 5:
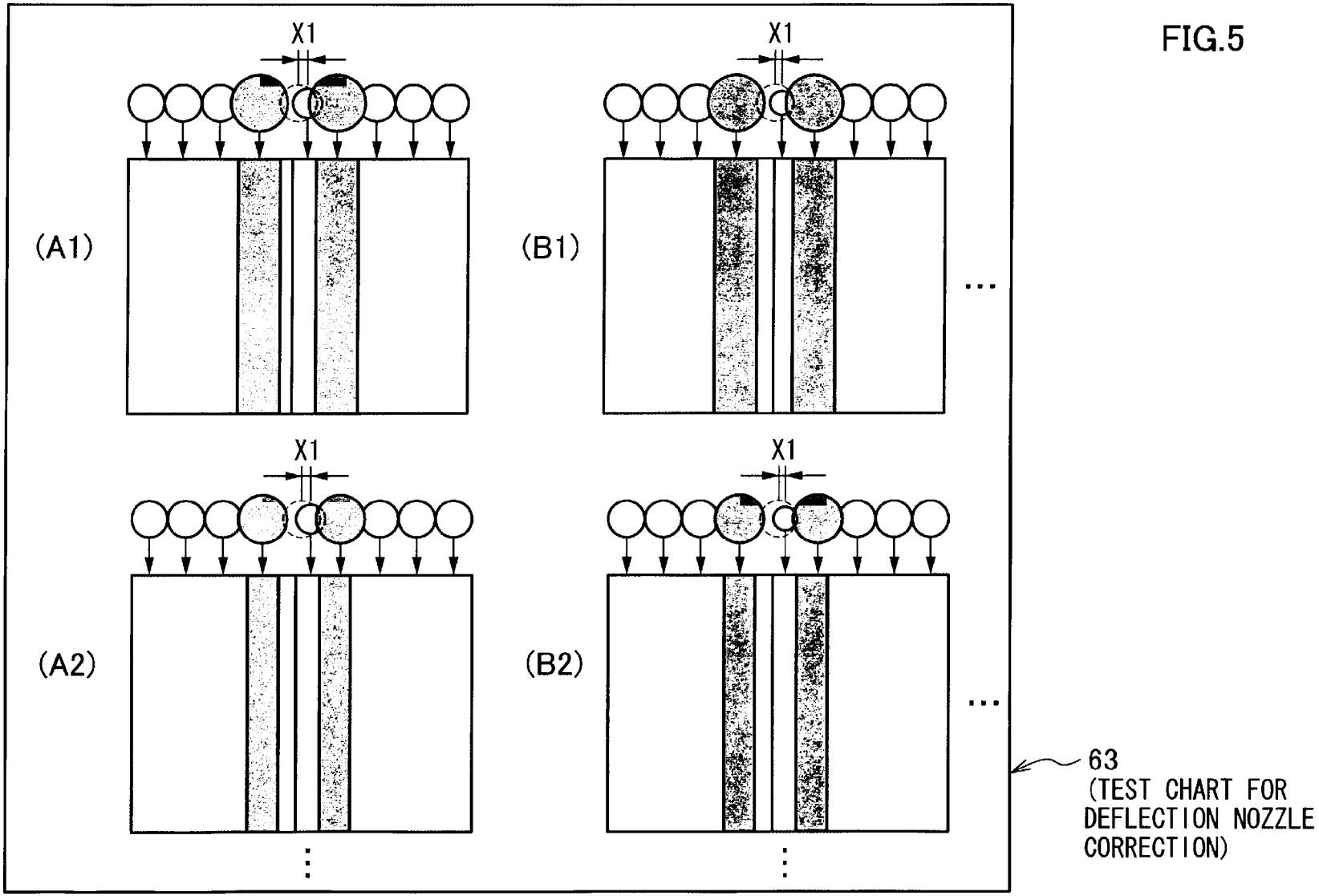
FIG. 5 is a schematic drawing of a test chart for deflecting nozzle correction.

As shown in FIG. 5, when generating deflecting nozzle correction data 60, a test chart for deflecting nozzle correction 63 is created and read by an external inspection apparatus. In the test chart for deflecting nozzle correction 63, a plurality of patches are formed in which, for example, the output density (ejection ink droplet volume) of the "deflecting nozzle N(E) having an amount of landing position displacement X1" is decreased in steps, using an inkjet head having a deflecting nozzle N(E) of which the amount of landing position displacement is known (FIG. 5 (A1), (B1), . . . ). Therefore, the output density of the deflecting nozzle N(E) is smaller than the output density of the other normally functioning nozzles (including adjacent nozzles before and after correction). Below, the output density of a deflecting nozzle N(E) is called the "deflecting nozzle output density".

Furthermore, simultaneously with this, the image setting values of the image formation positions of the adjacent nozzles N(A) are set to values obtained by multiplying a correction coefficient by the basic image setting value corresponding to a solid image of a prescribed density (tone value). A plurality of patches are formed by changing the correction coefficient in steps, in relation to the basic image setting value which corresponds to a particular density (FIG. 5 (A2), (B2), . . . ).

A group of patches is formed by forming patches while respectively changing the deflecting nozzle output density and the correction coefficient respectively, in relation to the deflecting nozzle N(E) having an amount of landing position displacement X1. Here, only a group of patches relating to one basic image setting value corresponding to a particular density is depicted, but similar groups of patches are formed for a plurality of basic image setting values of different densities (tone values). Furthermore, from a viewpoint of improving measurement accuracy (improving the reliability of measurement), a similar group of patches is formed in respect of a plurality of "deflecting nozzles having an amount of landing position displacement X1".

Thereafter, similarly, a group of patches is formed respectively for deflecting nozzles N(E) of a plurality of types which differ from the amount of landing position displacement X1.

In the external inspection apparatus, an upper limit value UL of the deflecting nozzle output density which achieves good visual characteristics (good output quality in which stripes are not conspicuous) is specified in respect of the deflecting nozzles N(E) having an amount of landing position displacement X1, for example, on the basis of the reading results of the test chart for deflecting nozzle correction 63. In this way, an upper limit value UL for the deflecting nozzle output density is specified for each basic image setting value, in respect of the deflecting nozzles N(E) having the amount of landing position displacement X1.

Furthermore, the inspection apparatus specifies a correction coefficient which obtains the best visual characteristics respectively for each deflecting nozzle output density, in respect of the deflecting nozzles N(E) having an amount of landing position displacement X1, for example, on the basis of the reading results of the test chart for deflecting nozzle correction 63. In this way, an optimal correction coefficient for each basic image setting value is specified for each deflecting nozzle output density, in respect of the deflecting nozzles N(E) having an amount of landing position displacement X1.

Thereafter, similarly, the inspection apparatus specifies an upper limit value of the deflecting nozzle output density for each basic image setting value, for each amount of landing position displacement. Furthermore, the inspection apparatus specifies an optimal correction coefficient for each basic image setting value, and for each deflecting nozzle output density and each amount of landing position displacement.

In this way, as shown in FIG. 6, deflecting nozzle correction data 60 including an output density limit LUT group 61 and an ejection correction LUT group 62, is generated. The output density limit LUT group 61 is constituted by output density limit LUTs 61*a* which are specified for each amount of landing position displacement. The ejection correction LUT group 62 is constituted by ejection correction LUTs 62*a* which are specified for each amount of landing position displacement and for each ink droplet volume.

The output density limit LUTs 61*a* are not depicted in the drawings, but are tables which associate an image setting value indicating an instructed solid density (base tone) for creating a test chart, and an upper limit value UL of the output density (ejected ink droplet volume) of a deflecting nozzle N(E), for example, a graph in which the vertical axis of the ejection failure nozzle correction LUT 46 shown in FIG. 3B is substituted with "upper limit value of output density". Furthermore, the ejection correction LUTs 62*a* are not depicted in the illustration, but are graphs which associate an image setting value with a correction coefficient which yields the best correction effect. The deflecting nozzle correction data 60 in the drawing shows one example of deflecting nozzle correction data.

<Nozzle Ejection Correction Processing>

Returning to FIG. 2, the nozzle ejection correction processing unit 23 of the printer 12 is provided with an ejection failure nozzle correction processing unit 65 and a deflecting nozzle correction processing unit 66. The ejection failure nozzle correction processing unit 65 and the deflecting nozzle correction processing unit 66 operate when image data is output (for instance, when image data 50 is input to the PC 14 (image processing circuit 20), etc.).

<Operation of Ejection Failure Nozzle Correction Processing Unit>

The ejection failure nozzle correction processing unit 65 is provided with a halt processing unit 65*a* and a signal conversion processing unit 65*b*. The halt processing unit 65*a* carries out ejection failure correction processing (for example, by setting the image setting value to 0) in respect of the ejection failure nozzles, on the basis of the nozzle numbers of the ejection failure nozzles in the abnormal nozzle information table 47. By this means, the ejection failure nozzles are disabled for ejection.

The signal conversion processing unit 65*b* operates after the ejection failure correction processing performed by the halt processing unit 65*a*. This signal conversion processing unit 65*b* applies signal conversion processing to the image signal after signal conversion processing by the tone conversion processing unit 22, on the basis of the ejection failure nozzle correction LUT 46 in the nozzle ejection correction data storage unit 42, in such a manner that the output density of the adjacent nozzles which are adjacent to an ejection failure nozzle is corrected.

Figure 7:
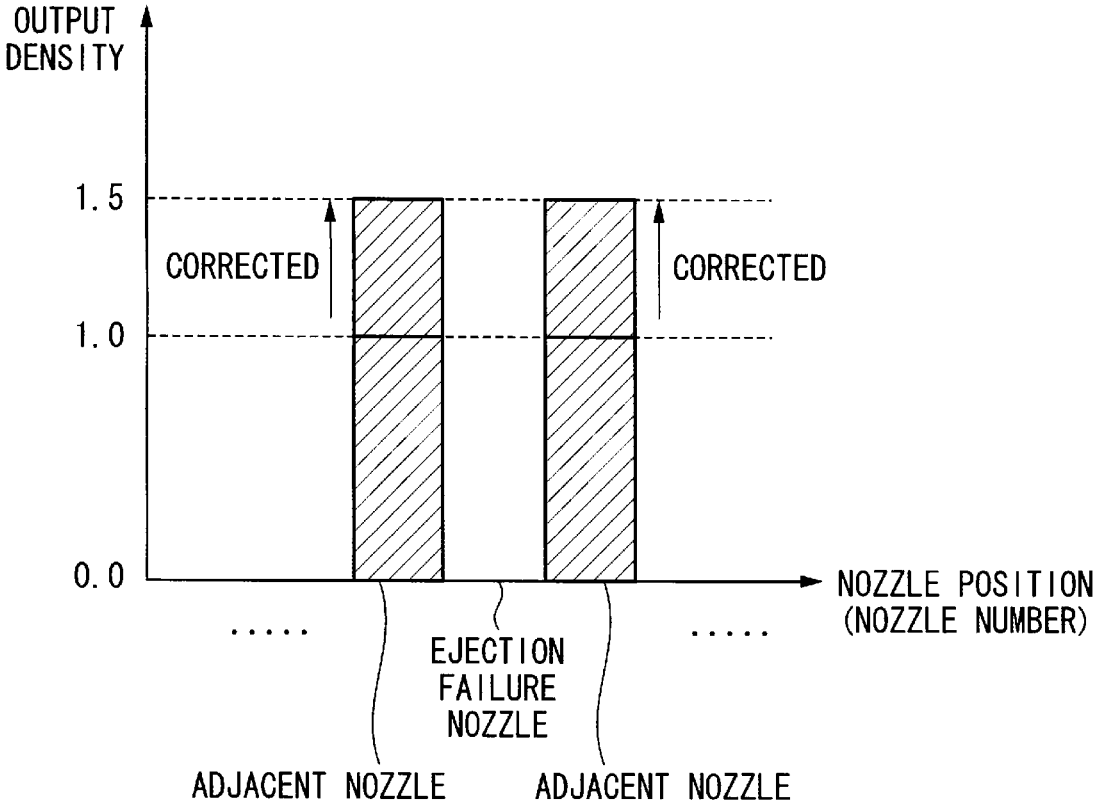
FIG. 7 is an illustrative diagram for describing correction processing performed by an ejection failure nozzle correction processing unit.

As shown in FIG. 7, by the signal conversion processing performed by the signal conversion processing unit 65*b*, the output density of the adjacent nozzles which are adjacent to an ejection failure nozzle is increased by a correction amount which is specified by the ejection failure nozzle correction LUT 46, for instance. In FIG. 7, the output density of the adjacent nozzles is increased from 1.0 (before correction) to 1.5 (after correction), for instance. FIG. 7 shows one example of correction of the output density of the adjacent nozzles, and the correction amount may be specified appropriately. Furthermore, the correction amounts of the two adjacent nozzles may be different. Moreover, as stated previously, the output density of the nozzles peripheral to the adjacent nozzles may also be corrected simultaneously. The image signal after signal conversion processing by the signal conversion processing unit 65*b* is sent to the halftone processing unit 24.

<Operation of Deflecting Nozzle Correction Processing Unit>

Returning to FIG. 2, the deflecting nozzle correction processing unit 66 is provided with a limit processing unit (droplet volume limiting device) 66*a* and a signal conversion processing unit (droplet volume correction device) 66*b*. The limit processing unit 66*a* refers to the deflecting nozzle correction data 60 and carries out output density limit processing for limiting the output density (ejected ink droplet volume) of a deflecting nozzle N(E), on the basis of the nozzle number of the deflecting nozzle N(E) in the abnormal nozzle information table 47, and the amount of landing position displacement and the output density. More specifically, the limit processing unit 66*a* refers to the output density limit LUT 61*a* corresponding to the amount of landing position displacement of the deflecting nozzle N(E), and applies signal conversion processing to the image signal after signal conversion processing by the tone conversion processing unit 22, in such a manner that the output density of the deflecting nozzle N(E) becomes not greater than the upper limit value UL specified by the output density limit LUT 61*a*. The limit processing unit 66*a* does not apply output density limit processing to deflecting nozzles N(E) having an output density which is not greater than the upper limit value UL.

The signal conversion processing unit 66*b* operates after the output density limit processing performed by the limit processing unit 66*a*. This signal conversion processing unit 66*b* refers to the deflecting nozzle correction data 60 and applies signal conversion processing to the image signal after signal conversion processing by the tone conversion processing unit 22, on the basis of the nozzle number of the deflecting nozzle N(E) in the abnormal nozzle information table 47, in such a manner that the output density of the adjacent nozzles N(A) is corrected. More specifically, the signal conversion processing unit 66*b* carries out signal conversion processing on the image signal so as to increase the output density of the adjacent nozzles N(A), by referring to the amount of landing position displacement in the abnormal nozzle information table 47 and the ejection correction LUT 62*a* corresponding to the output density of the deflecting nozzle N(E) after output density limit processing.

Figure 8:
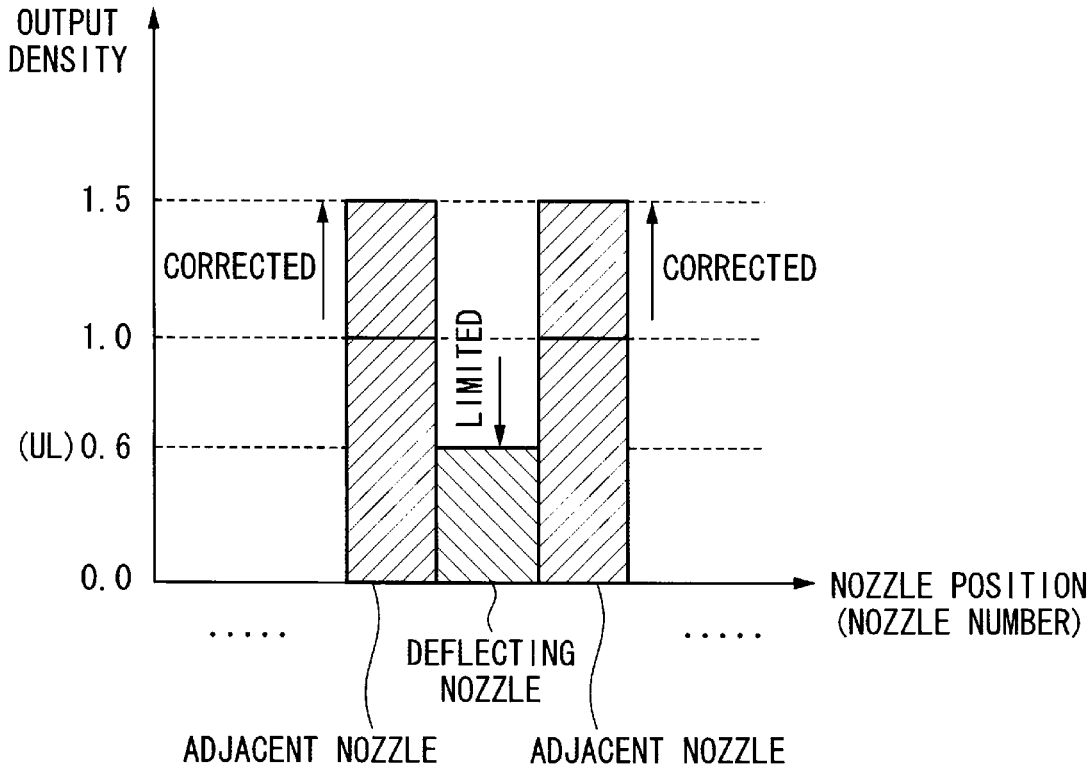
FIG. 8 is an illustrative diagram for describing correction processing performed by a deflecting nozzle correction processing unit.

As shown in FIG. 8, the output density of the deflecting nozzle is limited so as to be not greater than the upper limit value UL specified by the output density limit LUT 61*a*, by the output density limit processing performed by the limit processing unit 66*a* (after the signal conversion process). In FIG. 8, the output density of the deflecting nozzle N(E) is reduced from 1.0 (before correction) to the upper limit value UL (for example, 0.6). In the present embodiment, an output density of the deflecting nozzle N(E) is set to an upper limit value UL, but this output density may also be set to a value lower than the upper limit value UL.

Moreover, by the signal conversion processing performed by the signal conversion processing unit 66*b*, the output density of the adjacent nozzles N(A) is increased by a correction amount which is specified by the ejection correction LUT 62*a*, or the like. In FIG. 8, the output density of the adjacent nozzles is increased from 1.0 (before correction) to 1.5 (after correction), for instance. FIG. 8 shows one example of correction of the output density of the adjacent nozzles N(A), and it is also possible to set different correction amounts for both adjacent nozzles N(A), and to simultaneously correct the output density of the nozzles which are peripheral to the adjacent nozzles N(A). The image signal after signal conversion processing by the limit processing unit 66*a* and the signal conversion processing unit 66*b* is sent to the halftone processing unit 24.

<Action of Inkjet Printing System According to First Embodiment>

Figure 9:
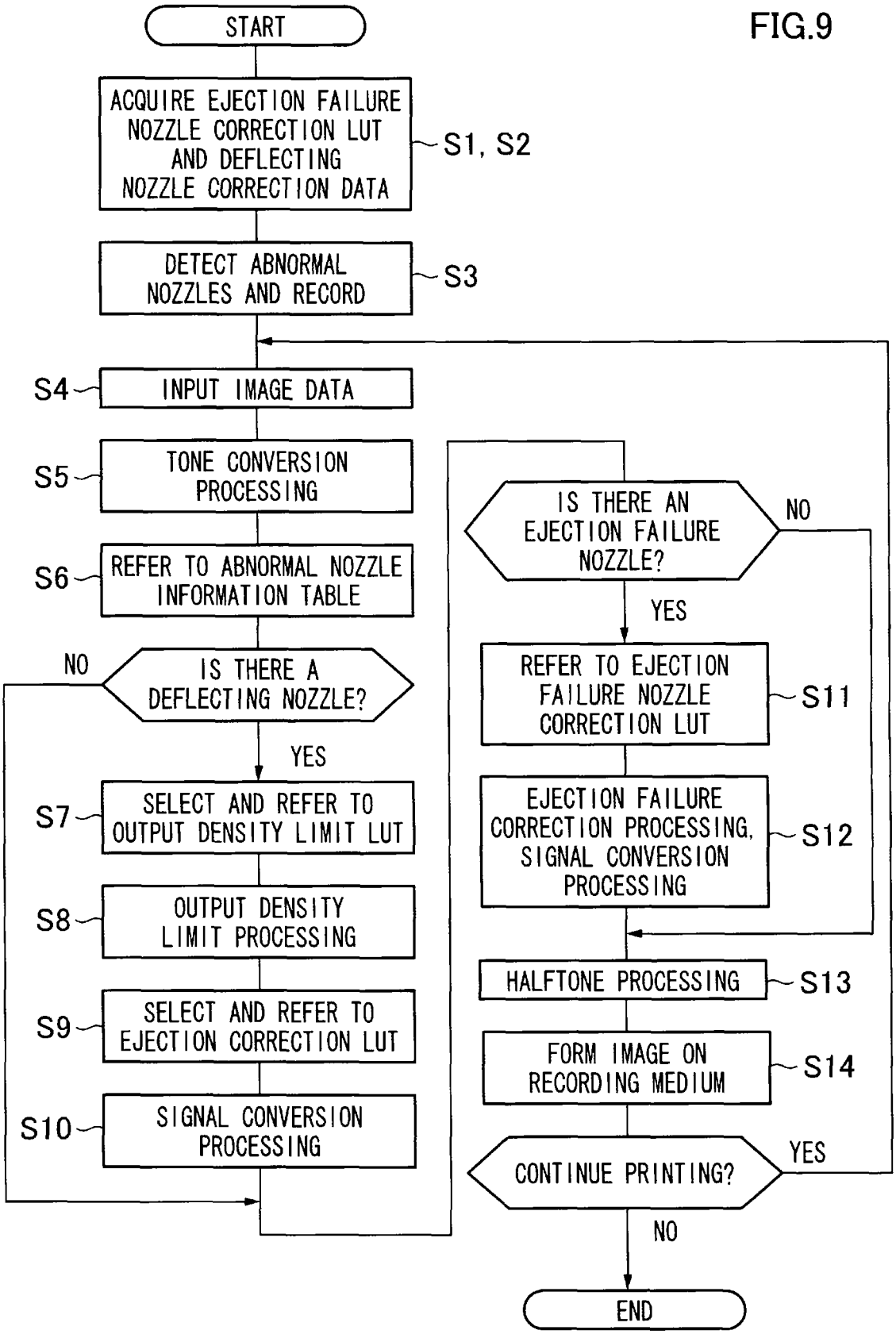
FIG. 9 is a flowchart for describing an action of an inkjet printing system according to a first embodiment.

Next, the action of the printing system 10 having the composition described above will be described with reference to the flow chart shown in FIG. 9. Before output of the image data 50 (before image recording), the ejection failure nozzle correction LUT 46 obtained by the ejection failure nozzle correction LUT generation processing stated above, and the deflecting nozzle correction data 60 obtained by the external inspection apparatus, and the like, are respectively stored in the nozzle ejection correction data storage unit 42 (steps S1 and S2).

Furthermore, before outputting the image data 50 (before image recording) the print processing control unit 30 sends a test chart creation and reading instruction to the printer 12, at a prescribed timing. Upon receiving this instruction, after recording (outputting) a test chart for abnormal nozzle detection 56 to the recording medium P by the marking unit 28, the test chart for abnormal nozzle detection 56 is read in by the in-line sensor 29. This reading result is sent to the abnormal nozzle detection unit 53.

Thereupon, the print processing control unit 30 sends an abnormal nozzle detection instruction to the abnormal nozzle detection unit 53. Upon receiving this instruction, the abnormal nozzle detection unit 53 analyzes the reading results of the test chart for abnormal nozzle detection 56 and detects (nozzle numbers indicating the positions of) abnormal nozzles, such as ejection failure nozzles and deflecting nozzles N(E), amongst the nozzles of the inkjet head 27. Furthermore, the abnormal nozzle detection unit 53 simultaneously determines the output density when a deflecting nozzle N(E) has been detected. Moreover, when a deflecting nozzle N(E) has been detected, the displacement amount determination unit 53*a* is operated, and an amount of landing position displacement is determined from the line pattern 58*a* corresponding to the deflecting nozzle N(E). Consequently, the nozzle number of ejection failure nozzles, and the nozzle numbers and amount of landing position displacement of deflecting nozzles N(E), are respectively recorded in the abnormal nozzle information table 47 (step S3: abnormal nozzle detection step).

The steps S1, S2, S3 described above may be executed at any timing, for instance, these steps may be executed at a suitable timing, such as when a start operation has been performed via the input apparatus 18, or before the start of a printing job, or each time a prescribed time period has elapsed, or when a prescribed number of prints has been made, or the like. Furthermore, step S3 may also be carried out before steps S1 and S2.

After inputting the image data 50 to the PC 14 (step S4), when a print start operation is performed at the input apparatus 18, the print processing control unit 30 sends the image data 50 to the PC 14 and also issues an image processing instruction to the image processing circuit 20. Upon receiving this instruction, the tone conversion processing unit 22, the nozzle ejection correction processing unit 23 and the halftone processing unit 24 of the image processing circuit 20 are operated.

The tone conversion processing unit 22 converts the image data 50 (image signal) that has been input from the PC 14, in accordance with a conversion relationship specified by the tone conversion LUT (step S5). Thereupon, each section of the nozzle ejection correction processing unit 23 (namely, the ejection failure nozzle correction processing unit 65 and the deflecting nozzle correction processing unit 66) is operated.

<Deflecting Nozzle Correction Processing>

The limit processing unit 66*a* of the deflecting nozzle correction processing unit 66 refers to the abnormal nozzle information table 47, checks whether or not the inkjet head 27 includes a deflecting nozzle N(E), and if the head does include a deflecting nozzle N(E), acquires the nozzle number, the amount of landing position displacement and the output density of that nozzle (step S6). Consequently, the position, amount of landing position displacement and output density of each deflecting nozzle N(E) is identified.

Next, the limit processing unit 66*a* selects and refers to an output density limit LUT 61*a* corresponding to the amount of landing position displacement of the deflecting nozzle N(E), from the output density limit LUT group 61 in the deflecting nozzle correction data 60 (step S7). Consequently, an upper limit value UL of the output density corresponding to the amount of landing position displacement of the deflecting nozzle N(E) is specified.

After the upper limit value UL has been specified, the limit processing unit 66*a* carries out signal conversion processing (output density limit processing) on the image signal that has undergone signal conversion processing by the tone conversion processing unit 22, in such a manner that the output density of a deflecting nozzle N(E) having an output density exceeding the upper limit value UL becomes not greater than the upper limit value UL (step S8: droplet volume limiting step). Consequently, although a deflecting nozzle N(E) is not disabled for ejection, the output density is limited to not greater than the upper limit value UL. As a result of this, the ink droplet volume which is ejected from the deflecting nozzle N(E) (the ink droplet volume forming one dot of the image: for example, the diameter of the ink dot or the average droplet volume of the ink ejected from the nozzles, etc.) is limited to not greater than a certain prescribed droplet volume.

After the output density limit processing, the signal conversion processing unit 66*b* refers to the ejection correction LUT group 62 in the deflecting nozzle correction data 60. The signal conversion processing unit 66*b* then selects and refers to an ejection correction LUT 62*a* which corresponds to the amount of landing position displacement of the deflecting nozzle N(E) and the output density of the deflecting nozzle N(E) after output density limit processing (for example, the upper limit value UL) (step S9). Accordingly, an optimal correction coefficient corresponding to the amount of landing position displacement and output density of the deflecting nozzle N(E) is specified.

Therefore, the signal conversion processing unit 66*b* applies signal conversion processing to the image signal after signal conversion processing by the tone conversion processing unit 22, so as to increase the output density of the adjacent nozzles N(A) which are adjacent to the deflecting nozzle N(E), in accordance with the previously specified correction coefficient (step S10: droplet volume correction step). Consequently, the output density of the adjacent nozzles N(A) is increased. More specifically, the ink droplet volume ejected from the adjacent nozzles N(A) is increased.

<Ejection Failure Nozzle Correction Processing>

The halt processing unit 65*a* of the ejection failure nozzle correction processing unit 65 refers to the abnormal nozzle information table 47, checks whether or not the inkjet head 27 includes an ejection failure nozzle, and if the head does include an ejection failure nozzle, acquires the nozzle number of that nozzle (step S11). Accordingly, the positions of ejection failure nozzles are identified.

Next, the halt processing unit 65*a* carries out ejection failure correction processing on the ejection failure nozzles (for example, by setting the image setting value to 0) (step S12). After this ejection failure correction processing, the signal conversion processing unit 65*b* applies signal conversion processing to the image signal after signal conversion processing by the tone conversion processing unit 22, on the basis of the ejection failure nozzle correction LUT 46, in such a manner that the output densities of the adjacent nozzles which are adjacent to an ejection failure nozzle are corrected (step S12). Accordingly, the ejection failure nozzles are disabled for ejection, and furthermore the output density of the adjacent nozzles is increased.

In the drawings, the deflecting nozzle correction processing (steps S6 to S10) is carried out first, but it is also possible to carry out the ejection failure nozzle correction processing (steps S11 to S12) first, or to carry out the deflecting nozzle correction processing and the ejection failure nozzle correction processing, simultaneously. Furthermore, in the nozzle ejection correction processing unit 23, apart from the deflecting nozzle correction processing and the ejection failure nozzle correction processing, it is also possible to carry out correction of density non-uniformities in the recorded image caused by fluctuation in the ejection characteristics (recording characteristics) of the respective nozzles. This correction of density non-uniformities is commonly known (see Japanese Patent Application Publication No. 2010-82989, for example) and therefore a concrete description thereof is omitted here.

<Other Processing>

The halftone processing unit 24 carries out halftone processing for converting a multiple-tone image signal which has undergone signal conversion processing by the respective sections of the nozzle ejection correction processing unit 23, into a multiple value signal (having four values, for example) (step S13). The multiple-value signal generated by the halftone processing is sent to the marking unit 28.

In the marking unit 28, under the control of the print processing control unit 30, driving of the respective nozzles of the inkjet head 27 is controlled on the basis of the multiple-value signals input from the halftone processing unit 24, and ink is ejected from the nozzles. By recording dots on a recording medium by the nozzles, while relatively moving the inkjet head 27 and the recording medium P, an image is formed on the recording medium P (step S14).

<Action and Beneficial Effects of the First Embodiment>

Figure 10A:
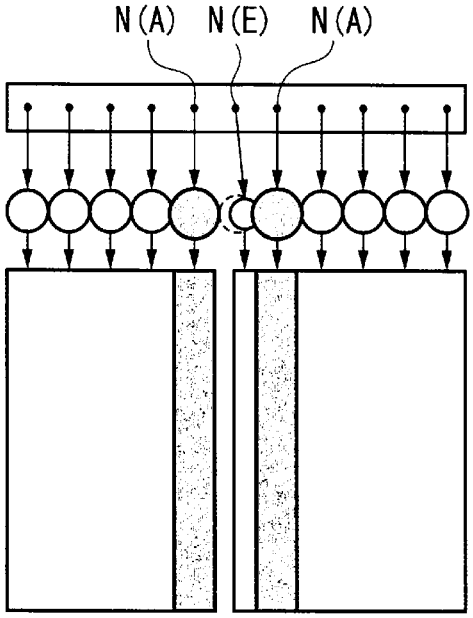
FIGS. 10A and 10B are illustrative diagrams for describing an action and beneficial effects of an inkjet printing system.
Figure 10B:
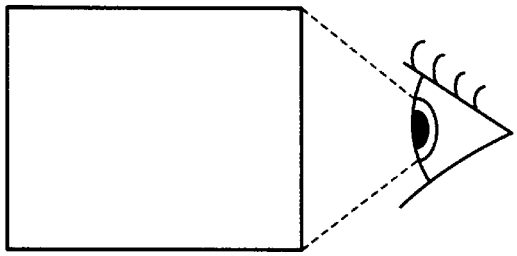
Figure 20A:
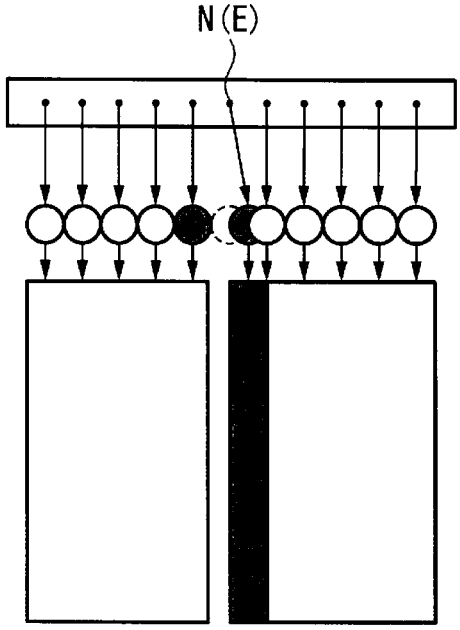
FIGS. 20A and 20B are illustrative diagrams for describing a stripe non-uniformity caused by a deflecting nozzle.
Figure 20B:
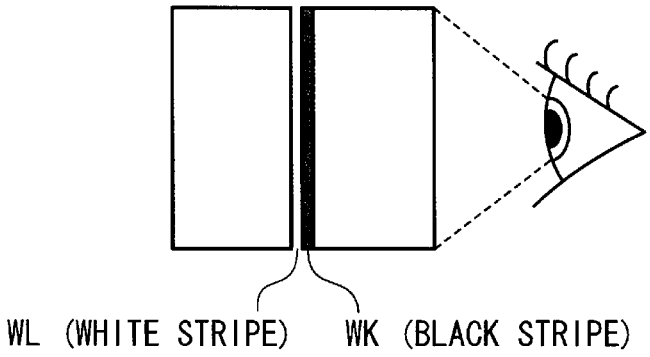
Figure 21A:
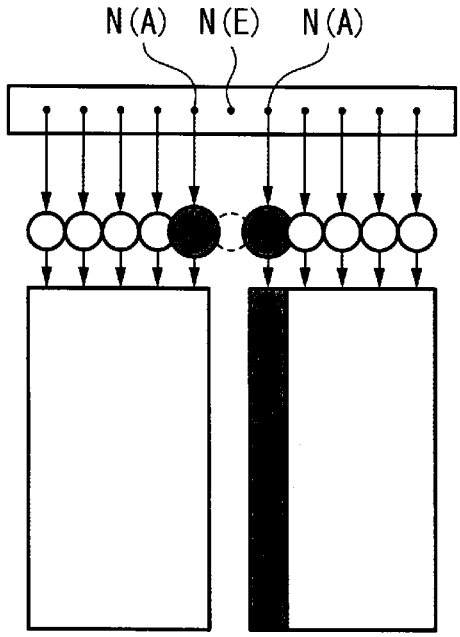
FIGS. 21A and 21B are illustrative diagrams for describing an example in which a stripe non-uniformity occurs, even though correction of a stripe non-uniformity caused by a deflecting nozzle has been carried out.
Figure 21B:
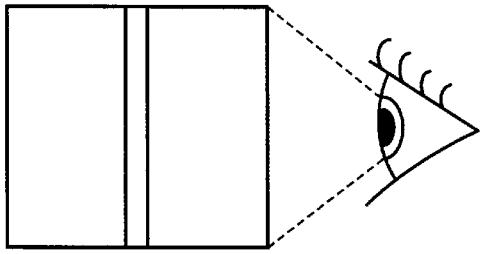
Figure 22A:
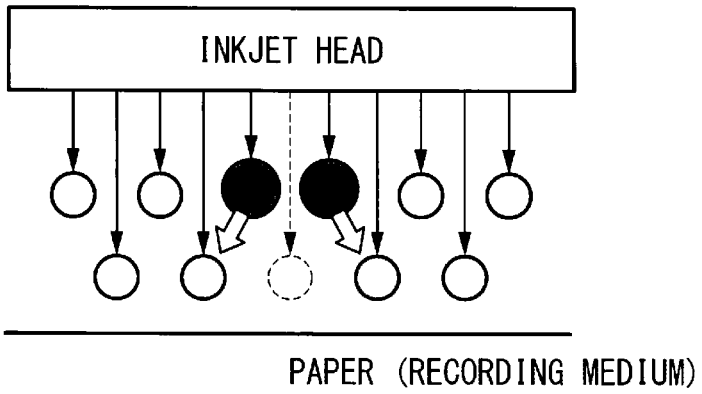
FIGS. 22A and 22B are illustrative diagrams for describing enlargement of the interval between droplets ejected from adjacent nozzles, due to landing interference.
Figure 22B:
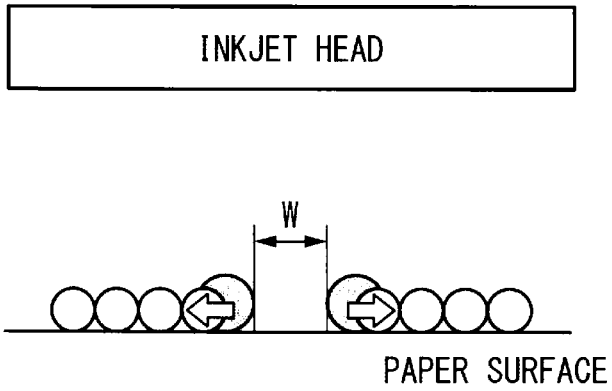

As shown in FIG. 10A, in the present embodiment, when a deflecting nozzle N(E) has occurred, this deflecting nozzle N(E) is limited to an output density not greater than the upper limit value UL, rather than being disabled for ejection, and the output density of the adjacent nozzles N(A) is increased. Therefore, even in cases where the interval between ink dots ejected from the adjacent nozzles N(A) increases due to the landing interference described in relation to FIG. 21A and FIG. 21B and FIG. 22A and FIG. 22B, it is still possible to carry out image recording using ink ejected from a deflecting nozzle N(E). As a result of this, it is possible to suppress the occurrence of stripe non-uniformities such as that shown in FIG. 21A and FIG. 21B. Furthermore, since the output density of the deflecting nozzle N(E) is limited, then the occurrence of a strip non-uniformity such as that shown in FIG. 20A and FIG. 20B is also suppressed. Consequently, as shown in FIG. 10B, it is possible to suppress non-uniformities (stripe non-uniformities) in the image caused by deflecting nozzles, and hence a good image is obtained.

Furthermore, by ejecting ink from deflecting nozzles N(E), it is possible to reduce the ink droplet volume (the ink use volume) which is ejected from the adjacent nozzles N(A). Consequently, the occurrence of problems such as destabilization of the landing positions due to the ink droplet volume ejected from the adjacent nozzles N(A) becoming too large, is prevented.

Moreover, in the present embodiment, the upper limit value UL of the output density of a deflecting nozzle N(E) (the ejected ink droplet volume) is varied in accordance with the amount of landing position displacement of the deflecting nozzle N(E). Therefore, for instance, if the amount of landing position displacement is small (if the extent of the problem with the deflecting nozzle N(E) is small), then it is possible to increase the output density by increasing the upper limit value UL. Furthermore, if, conversely, the amount of landing position displacement is large (if the extent of the problem with the deflecting nozzle N(E) is large), then it is possible to reduce the output density by reducing the upper limit value UL. Consequently, a non-uniformity (stripe non-uniformity) of the image caused by the deflecting nozzle N(E) can be suppressed more reliably, and therefore a good image is obtained.

Moreover, in the present embodiment, the output density of the adjacent nozzles N(A) (the ejected ink droplet volume) is varied in accordance with the amount of landing position displacement of the deflecting nozzle N(E), and the like. Consequently, the occurrence of non-uniformities (stripe non-uniformities) in the image is suppressed more reliably. Moreover, since the output density of the adjacent nozzles N(A) can be reduced, then it is possible to reduce the amount of ink used.

Further Composition According to First Embodiment

In the first embodiment described above, the upper limit value UL of the output density (ejected ink droplet volume) of deflecting nozzles N(E) is varied in accordance with the amount of landing position displacement of the deflecting nozzles N(E), but it is also possible to set a certain prescribed upper limit value UL, regardless of the amount of landing position displacement. In this case, it is possible to eliminate the task of determining a plurality of output density limit LUTs 61*a*. Moreover, by setting a prescribed upper limit value UL, it is possible to determine the ejection correction LUTs 62*a* in a simple fashion (for example, to determine an ejection correction LUT for each amount of landing position displacement, without taking account of the output density of the deflecting nozzle N(E)).

Composition of Inkjet Printing System According to Second Embodiment

Figure 11:
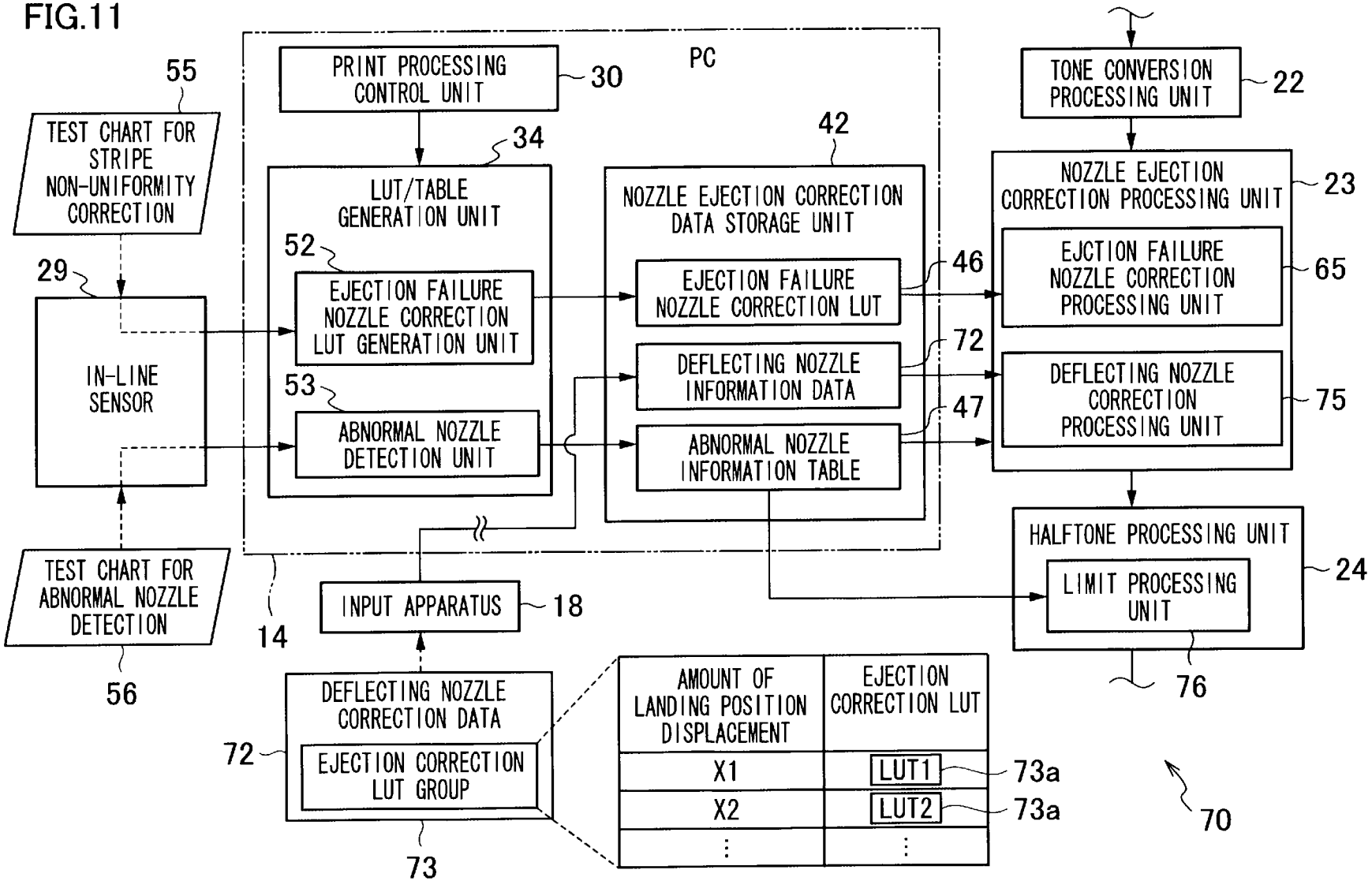
FIG. 11 is a block diagram showing an electrical composition of an inkjet printing system according to a second embodiment.

Next, a printing system 70 according to a second embodiment of the present invention will be described with reference to FIG. 11. In the printing system 10 according to the first embodiment described above, image processing (signal conversion processing) is applied to the image data before halftone processing, in order to limit the output density of deflecting nozzles N(E) to not greater than an upper limit value UL. On the other hand, in the printing system 70, only small droplets are ejected from the deflecting nozzles N(E), by amending the multiple-value signal (having four values, for example) after halftone processing.

The printing system 70 has basically the same composition as the printing system 10 according to the first embodiment described above, except for the fact that the image processing is applied to the dot data after halftone processing. Consequently, parts which have the same function and/or composition as the first embodiment described above are labeled with the same reference numerals, and description thereof is omitted here.

<Composition of PC According to Second Embodiment>

The PC 14 according to the second embodiment has basically the same composition as the PC 14 according to the first embodiment, apart from the fact that deflecting nozzle correction data 72 which is different to that of the first embodiment is stored in the nozzle ejection correction data storage unit 42.

The deflecting nozzle correction data 72 is composed by an ejection correction LUT group 73 which is different to the first embodiment. The ejection correction LUT group 73 is constituted by ejection correction LUTs 73*a* which are specified for each amount of landing position displacement. The ejection correction LUTs 73*a* are generated by specifying an "optimal correction coefficient" for each basic image setting value, for each amount of landing position displacement, through analyzing a test chart which is basically the same as the test chart for deflecting nozzle correction 63 shown in FIG. 5 (the ink ejected from deflecting nozzles N(E) is fixed to a small droplet in this test chart).

<Composition of Printer According to Second Embodiment>

The printer 12 according to the second embodiment has basically the same composition as the printer 12 according to the first embodiment, apart from the fact that a deflecting nozzle correction processing unit (droplet volume correction device) 75 that is different to the first embodiment is provided in the nozzle ejection correction processing unit 23, and a limit processing unit (droplet volume limiting device) 76 is provided in the halftone processing unit 24.

The deflecting nozzle correction processing unit 75 corrects the output density of the adjacent nozzles N(A) similarly to the signal conversion processing unit 66*b* of the first embodiment, without carrying out output density limit processing for the deflecting nozzles N(E) described in the first embodiment. More specifically, the signal conversion processing unit 66*b* carries out signal conversion processing on the image signal so as to increase the output density of the adjacent nozzles N(A), by referring to the ejection correction LUT 73*a* corresponding to the amount of landing position displacement of the deflecting nozzle N(E) in the abnormal nozzle information table 47.

The limit processing unit 76 carries out output density limit processing for limiting the output density (ejected ink droplet volume) of a deflecting nozzle N(E) having an output density exceeding the upper limit value UL to not greater than the upper limit LU, on the basis of the nozzle number of the deflecting nozzle N(E) in the abnormal nozzle information table 47. More specifically, a signal for "eject large-droplet ink" and a signal for "eject medium-droplet ink" corresponding to a deflecting nozzle N(E), in the multiple-value signal (having four values, for example) after halftone processing by the halftone processing unit 24, are amended to a signal for "eject small-droplet ink". In the present embodiment, amendment is not carried out when the signal corresponding to a deflecting nozzle is "do not eject".

<Action of Inkjet Printing System According to Second Embodiment>

Figure 12:
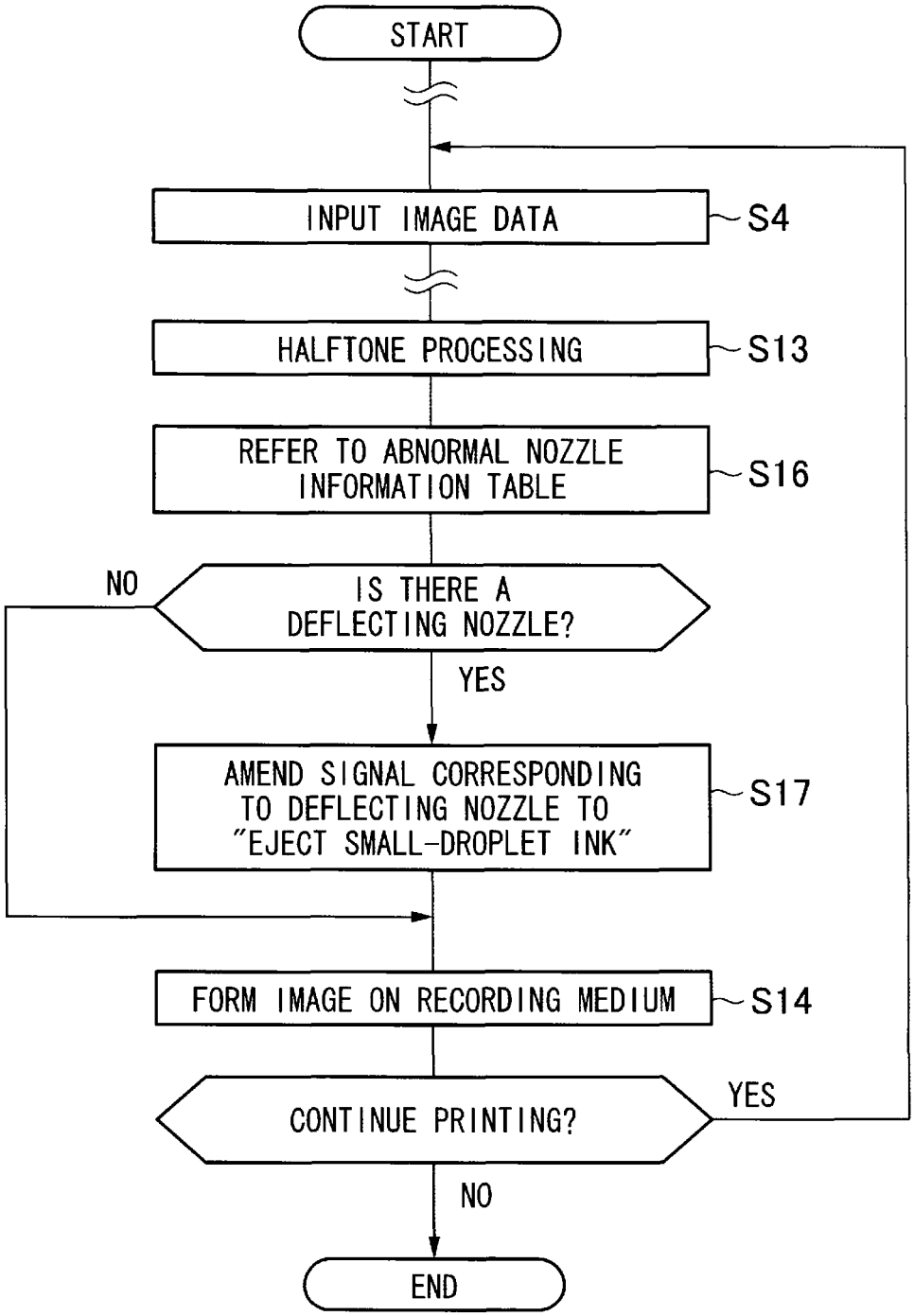
FIG. 12 is a flowchart for describing an action of an inkjet printing system according to a second embodiment.

Next, the action of the printing system 70 having the composition described above will be described with reference to the flow chart shown in FIG. 12. The flow of processing up to the halftone processing (step S13) is basically the same as the flow of processing according to the first embodiment which was illustrated in FIG. 9, and therefore a description thereof is not given here. However, in the printing system 70, the output density limit processing performed by the deflecting nozzle correction processing unit 75 (corresponding to steps S7, S8 in FIG. 9) is not carried out. Furthermore, the ejection failure nozzle correction processing (steps S11, S12 in FIG. 9) is similar to the first embodiment, and therefore description thereof is omitted here.

The limit processing unit 76 of the halftone processing unit 24 operates upon receiving an instruction from the print processing control unit 30 after halftone processing. The limit processing unit 76 refers to the abnormal nozzle information table 47, checks whether or not the inkjet head 27 includes a deflecting nozzle N(E), and if the head does include a deflecting nozzle N(E), acquires the nozzle number and output density of that nozzle (step S16). Accordingly, the positions of deflecting nozzles N(E) are identified.

Thereupon, the limit processing unit 76 amends signals for "eject large-droplet ink" and "eject medium-droplet ink" corresponding to the deflecting nozzles having an output density that exceeds the upper limit value UL, in the multiple-value signal after halftone processing, to a signal for "eject small-droplet ink" (step S17). Consequently, the deflecting nozzles N(E) are not disabled for ejection, but the ink ejected from the deflecting nozzles N(E) is limited to a droplet volume not greater than a small droplet. In other words, the output density of the deflecting nozzles N(E) is limited to not greater than the upper limit value UL, similarly to the first embodiment.

The multiple-value signal after halftone processing (including the signal amended by the limit processing unit 76) is sent to the marking unit 28, whereupon an image is formed on the recording medium P similarly to the first embodiment.

Action and Beneficial Effects of the Second Embodiment

Similarly to the first embodiment, since the output density of the deflecting nozzles N(E) is limited, and the output density of the adjacent nozzles N(A) is also increased, then similar beneficial effects to the beneficial effects described in the first embodiment are obtained.

<Further Composition According to Second Embodiment>

In the second embodiment described above, no amendment is carried out when the signal corresponding to a deflecting nozzle N(E) is "do not eject", but it is also possible to amend a signal for "do not eject" to a signal for "eject small-droplet ink". Furthermore, in the second embodiment described above, a signal for "eject large-droplet ink or medium-droplet ink" corresponding to a deflecting nozzle N(E) having an output density that exceeds the upper limit value UL is amended to a signal for "eject small-droplet ink", but it is also possible to amend the signals of all deflecting nozzles N(E) regardless of the output density.

In the second embodiment described above, the ink droplet volume ejected from a deflecting nozzle N(E) is limited to not greater than a small droplet, but it is also possible to limit the ink droplet volume to not greater than a droplet type selected from amongst droplets of a plurality of types (for example, not greater than a medium droplet), provided that the output density (ejected ink droplet volume) can be limited to not greater than the upper limit value UL.

Composition of Inkjet Printing System According to Third Embodiment

Figure 13:
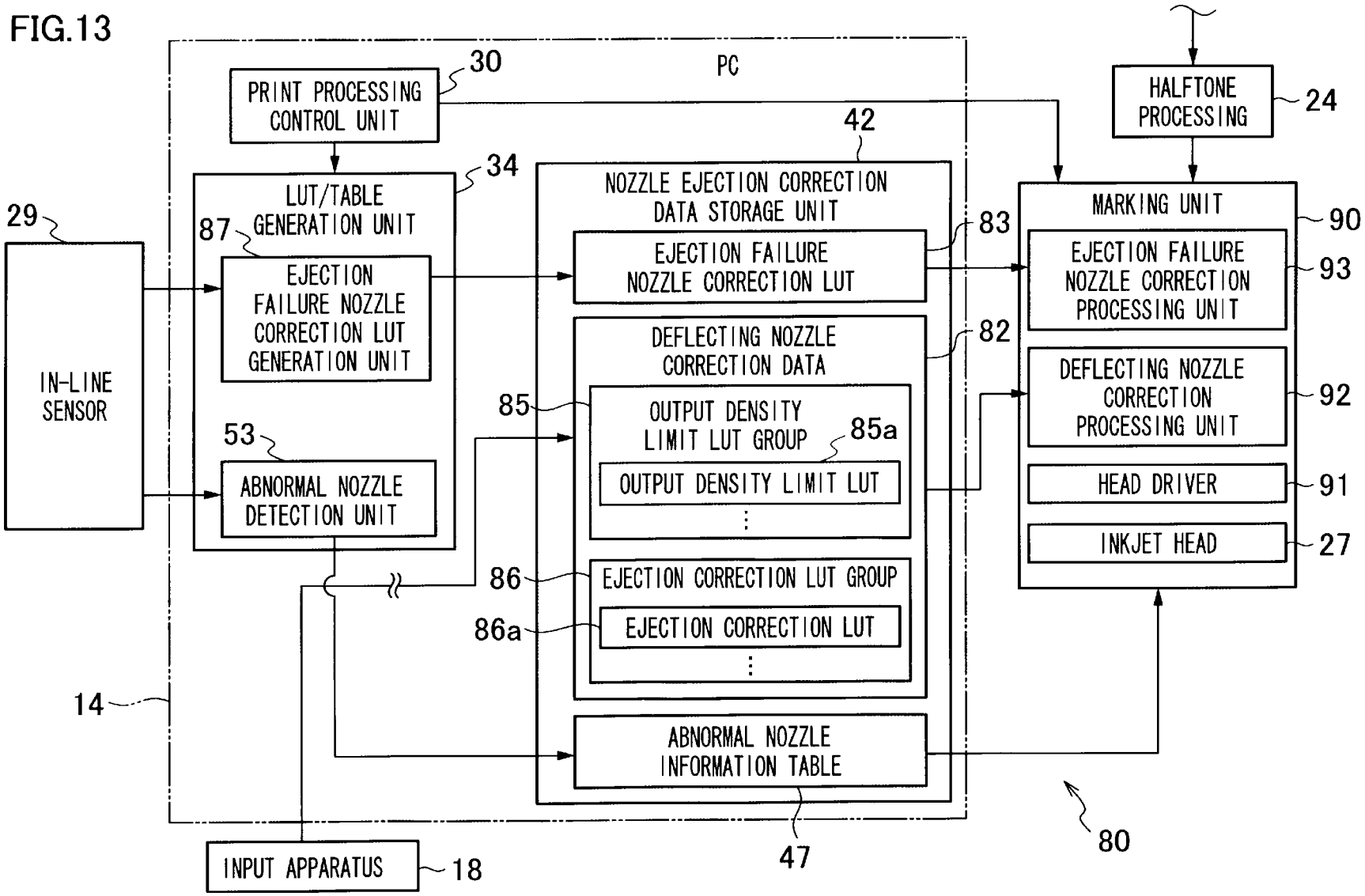
FIG. 13 is a block diagram showing an electrical composition of an inkjet printing system according to a third embodiment.

Next, a printing system 80 according to a third embodiment of the present invention will be described with reference to FIG. 13. In the printing systems 10 and 70 according to the first and second embodiments described above, limitation of the output density of the deflecting nozzles N(E) and correction of the output density of the adjacent nozzles N(A) is carried out by image processing. On the other hand, in the printing system 80, the output density of deflecting nozzles N(E) is limited and the output density of adjacent nozzles N(A) is corrected by adjusting the drive signal which drives the respective nozzles of the inkjet head 27.

The printing system 80 basically has a similar composition to the printing system 10 according to the first embodiment which was described above, and therefore parts having the same function and/or composition as the first embodiment described above are labeled with the same reference numerals and description thereof is omitted here.

<Composition of PC According to Third Embodiment>

The PC 14 according to the third embodiment has basically the same composition as the PC 14 according to the first embodiment, apart from the fact that deflecting nozzle correction data 82 and ejection failure nozzle correction LUTs 83 which are different to those of the first embodiment are stored in the nozzle ejection correction data storage unit 42.

The deflecting nozzle correction data 82 has an output density limit LUT group 85 which is used to adjust the drive signals of deflecting nozzles N(E) (which is used in output density limit processing) and an ejection correction LUT group 86 which is used to adjust the drive signals of adjacent nozzles N(A) (which is used for correction of the output density).

The output density limit LUT group 85 is constituted by output density limit LUTs 85*a* which are specified for each amount of landing position displacement, similarly to the output density limit LUT group 61 (see FIG. 6) of the first embodiment. The individual output density limit LUTs 85*a* specify an upper limit value UL' (see FIG. 14) for the magnitude of the drive signal for a deflecting nozzle N(E) which achieves good visibility, in respect of each basic image setting value.

The ejection correction LUT group 86 is constituted by ejection correction LUTs 86*a* which are specified respectively for each amount of landing position displacement and for each upper limit value UL'. The individual ejection correction LUTs 86*a* specify a correction coefficient for correcting the drive signal of the adjacent nozzles N(A), in other words, an optimal correction coefficient which achieves the best visual characteristics, for each basic image setting value. The method of generating the respective output density limit LUTs 85*a* and the respective ejection correction LUTs 86*a* is basically the same as the method for generating the output density limit LUTs 61*a* and the ejection correction LUTs 62*a* according to the first embodiment, and therefore description thereof is omitted here.

The ejection failure nozzle correction LUTs 83 specify a correction coefficient for correcting the drive signal of the adjacent nozzles (nozzles adjacent to an ejection failure nozzle), in other words, an optimal correction coefficient which achieves the best visual characteristics, for each basic image setting value. This ejection failure nozzle correction LUT 83 is generated by an ejection failure nozzle correction LUT generation unit 87. The method of generating an ejection failure nozzle correction LUT 83 is basically the same as the method of generating an ejection failure nozzle correction LUT 46 according to the first embodiment, and therefore description thereof is not given here.

<Composition of Printer According to Third Embodiment>

The printer 12 according to the third embodiment has basically the same composition as the PC 14 according to the first embodiment, apart from the fact that deflecting nozzle correction processing and ejection failure nozzle correction processing is carried out in the marking unit 90.

The marking unit 90 is provided with a head driver 91 which sends drive signals respectively to the nozzles of the inkjet head 27, a deflecting nozzle correction processing unit (droplet volume limiting device, droplet volume correction device) 92, and an ejection failure nozzle correction processing unit 93.

The deflecting nozzle correction processing unit 92 refers to the output density limit LUT 85*a* corresponding to the amount of landing position displacement of a deflecting nozzle N(E), on the basis of the nozzle number and the amount of landing position displacement of the deflecting nozzle N(E) in the abnormal nozzle information table 47. The deflecting nozzle correction processing unit 92 then executes drive signal limit processing for limiting the magnitude of the drive signal for the deflecting nozzle N(E) which is output from the head driver 91, on the basis of the output density limit LUT 85*a*.

Figure 14:
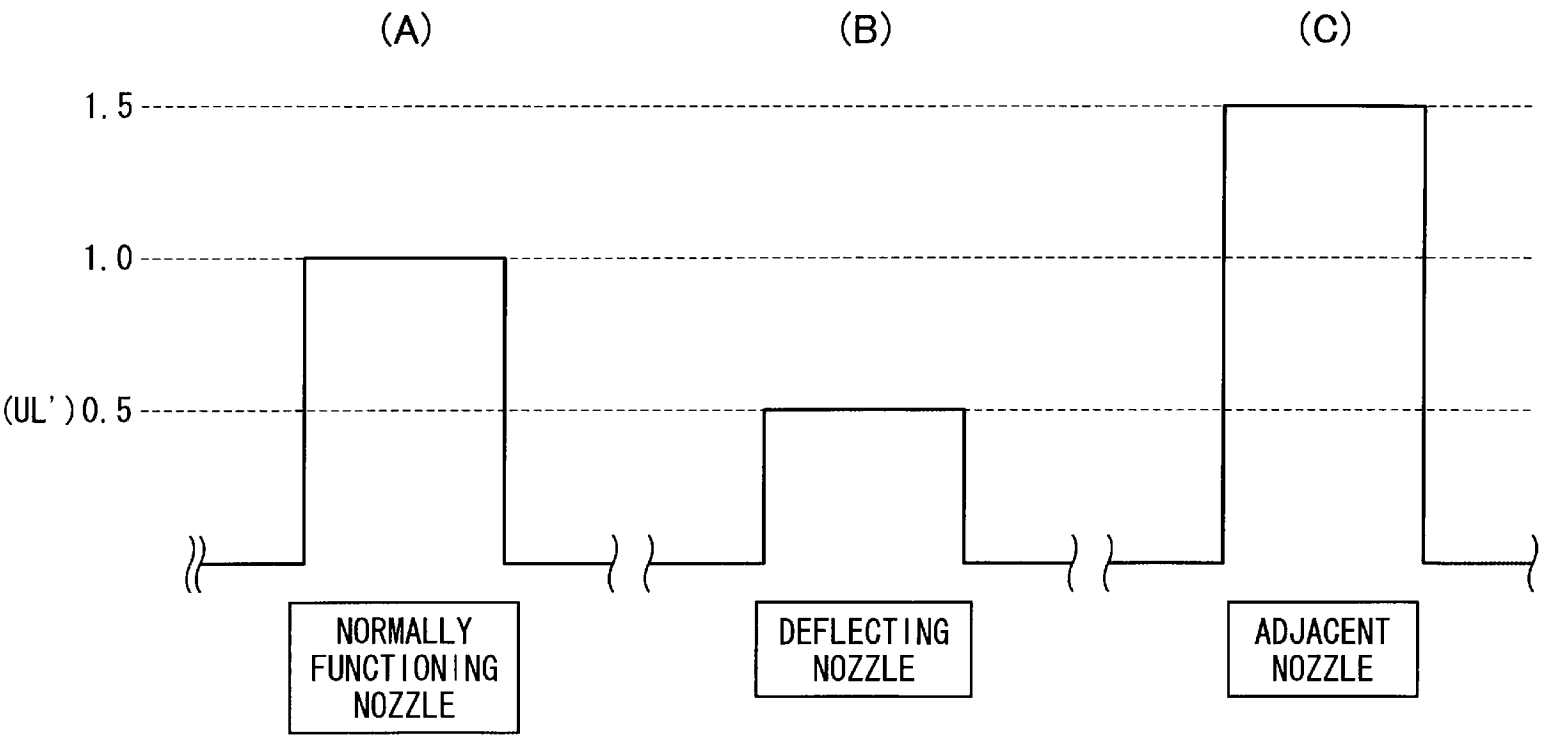
FIG. 14 is an illustrative diagram for describing correction processing performed by a deflecting nozzle correction processing unit.
Figure 15:
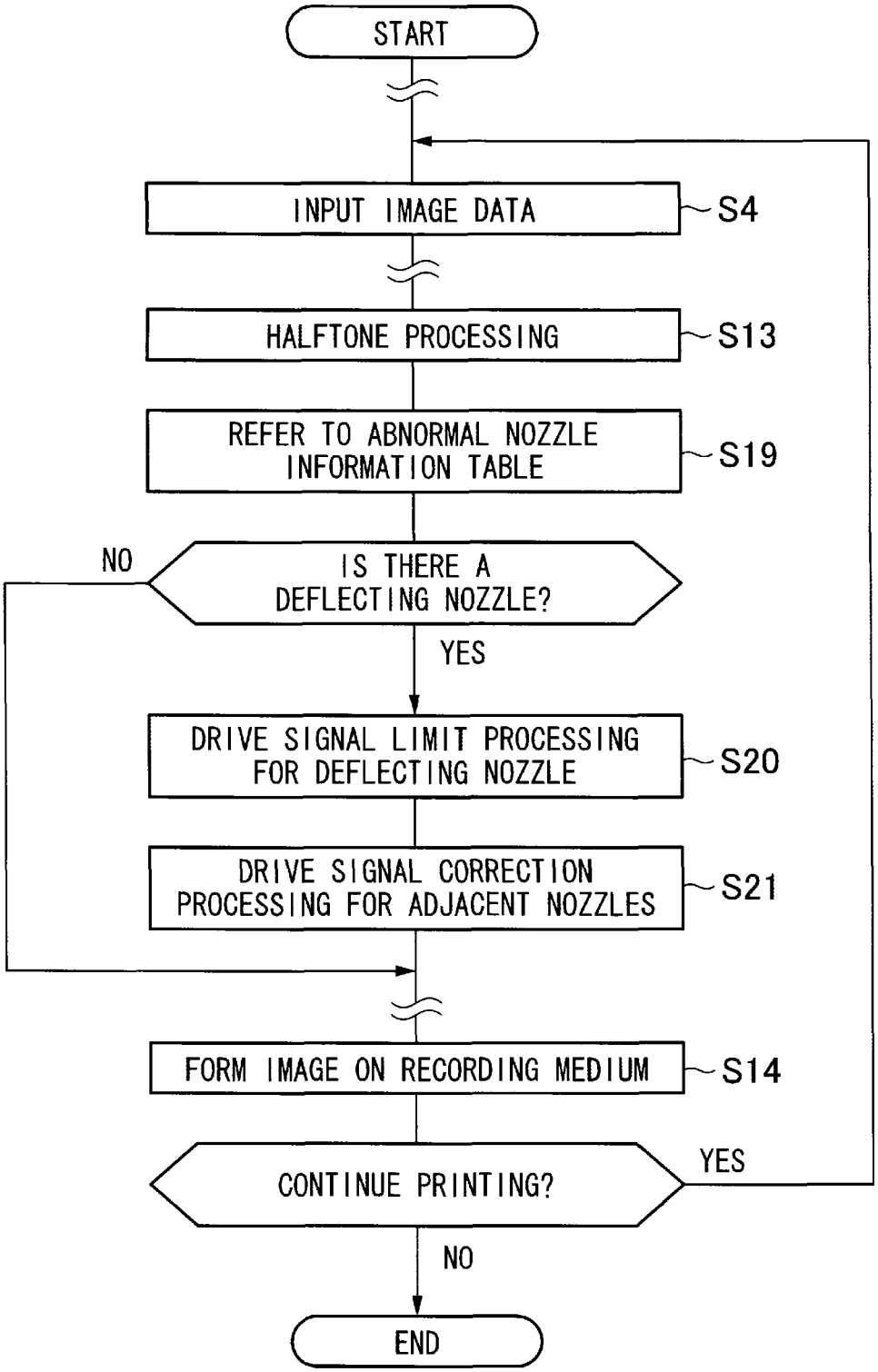
FIG. 15 is a flowchart for describing an action of an inkjet printing system according to a third embodiment.

More specifically, as shown in (A) and (B) in FIG. 14, the head driver 91 is controlled in such a manner that the magnitude of the drive signal (waveform) for the deflecting nozzle N(E) becomes not greater than the upper limit value UL' specified by the output density limit LUT 85*a*. Consequently, the magnitude (amplitude) of the drive signal for the deflecting nozzle N(E) is limited to a range from 1.0 before correction, to not greater than 0.5 of the upper limit value UL'. In the present embodiment, the magnitude of the drive signal is adjusted to the upper limit value UL', but it may also be adjusted to a value lower than the upper limit value UL'. By limiting the magnitude of the drive signal in this way, similarly to the first and second embodiments, the output density of the deflecting nozzle N(E) (the ejected ink droplet volume) is limited.

Furthermore, the deflecting nozzle correction processing unit 92 refers to the ejection correction LUT 86*a* corresponding to the amount of landing position displacement of the deflecting nozzle N(E) and the upper limit value UL', and implements drive signal correction processing for correcting the magnitude of the drive signal for the adjacent nozzles N(A) which is output from the head driver 91. More specifically, the head driver 91 is controlled in such a manner that a drive signal which has been corrected by an optimal correction coefficient specified by the ejection correction LUT 86*a* is output to the adjacent nozzles N(A). Consequently, as shown in (C) in FIG. 14, the magnitude (amplitude) of the drive signal for the adjacent nozzles N(A) is increased from 1.0 before correction, to 1.5, for example.

Returning to FIG. 13, the ejection failure nozzle correction processing unit 93 carries out ejection failure correction processing (for setting the magnitude (amplitude) of the drive signal to 0, for example) on the ejection failure nozzles, on the basis of the nozzle numbers of the ejection failure nozzles in the abnormal nozzle information table 47. By this means, the ejection failure nozzles are disabled for ejection.

Furthermore, the ejection failure nozzle correction processing unit 93 also corrects the magnitude (amplitude) of the drive signal for the adjacent nozzles which are adjacent to the ejection failure nozzles, on the basis of the ejection failure nozzle correction LUT 83. Consequently, the magnitude of the drive signal is increased by an amount of correction specified by the ejection failure nozzle correction LUT 83.

Action of Inkjet Printing System According to Third Embodiment

Next, the action of the printing system 80 having the composition described above will be described with reference to the flow chart shown in FIG. 13. The flow of processing up to the halftone processing (step S13) is basically the same as the flow of processing according to the first embodiment which was illustrated in FIG. 9, and therefore a description thereof is not given here. However, in the printing system 80, the deflecting nozzle correction processing (steps S6 to S10) before halftone processing and the ejection failure correction processing (steps S11, S12) are not carried out.

When the multiple-value signal after halftone processing has been sent to the marking unit 90, the head driver 91 receives an instruction from the print processing control unit 30 and operates. The head driver 91 starts image recording by driving the nozzles of the inkjet head 27 on the basis of a multiple-value signal input from the halftone processing unit 24. Furthermore, simultaneously with this, the deflecting nozzle correction processing unit 92 and the ejection failure nozzle correction processing unit 93 are operated.

The deflecting nozzle correction processing unit 92 refers to the abnormal nozzle information table 47 and acquires the nozzle numbers and the amount of landing position displacement thereof (step S19). Consequently, the position and amount of landing position displacement of each deflecting nozzle N(E) is identified.

Thereupon, the deflecting nozzle correction processing unit 92 selects and refers to an output density limit LUT 85*a* corresponding to the amount of landing position displacement of the deflecting nozzle N(E), from among the output density limit LUT group 85. Consequently, an upper limit value UL' of the magnitude of the drive signal corresponding to the amount of landing position displacement of the deflecting nozzle N(E) is specified.

When the upper limit value UL' has been specified, the deflecting nozzle correction processing unit 92 executes drive signal limit processing and controls the head driver 91 in such a manner that the magnitude of the drive signal for deflecting nozzles N(E) is not greater than the upper limit value UL' specified by the output density limit LUT 85*a* (step S20). In this way, by limiting the magnitude of the drive signal for the deflecting nozzles N(E), without disabling ejection from these deflecting nozzles N(E), the output density is limited to not greater than a certain prescribed density (the ejected ink droplet volume is limited to not greater than a certain prescribed droplet volume).

Moreover, the deflecting nozzle correction processing unit 92 refers to the ejection correction LUT 86*a* which corresponds to the amount of landing position displacement of the deflecting nozzle N(E) and the upper limit value UL', from among the ejection correction LUT group 86. Consequently, an optimal correction coefficient corresponding to the amount of landing position displacement of the deflecting nozzle N(E) and the upper limit value UL' is specified.

Thereupon, the deflecting nozzle correction processing unit 92 executes drive signal correction processing, and controls the head driver 91 in such a manner that the magnitude of the drive signal for adjacent nozzles N(A) is increased in accordance with the previously specified correction coefficient (step S21). By increasing the magnitude of the drive signal, the output density of the adjacent nozzles is increased. More specifically, the ink droplet volume ejected from the adjacent nozzles is increased.

Furthermore, although not shown in the drawings, if the ejection failure nozzle correction processing unit 93 finds that the inkjet head 27 includes an ejection failure nozzle, as a result of referring to the abnormal nozzle information table 47, then it applies ejection failure correction processing to the ejection failure nozzle (for example, by setting the magnitude (amplitude) of the drive signal to 0). Moreover, the ejection failure nozzle correction processing unit 93 also controls the head driver 91 in such a manner that the magnitude of the drive signal of the adjacent nozzles which are adjacent to the ejection failure nozzle is increased, on the basis of the ejection failure nozzle correction LUT 83. Accordingly, the ejection failure nozzle is disabled for ejection, and furthermore the output density of the adjacent nozzles is increased.

Thereafter, similarly to the first and second embodiments described above, by recording dots on a recording medium by the nozzles, while relatively moving the inkjet head 27 and the recording medium P, an image is formed on the recording medium P (step S14).

<Action and Beneficial Effects of the Third Embodiment>

Similarly to the first embodiment, since the output density of the deflecting nozzles N(E) is limited, and the output density of the adjacent nozzles N(A) is also increased, then similar beneficial effects to the beneficial effects described in the first embodiment are obtained.

Further Composition According to Third Embodiment

In the third embodiment described above, the magnitude (amplitude) of the drive signals for the nozzles is adjusted so as to limit the output density of the deflecting nozzles N(E) and to increase the output density of the adjacent nozzles N(A), but it is also possible to adjust the pulse width and frequency of the drive signals, for example.

Furthermore, in the third embodiment described above, the upper limit value UL' of the magnitude of the drive signal for the deflecting nozzle N(E) is varied in accordance with the amount of landing position displacement of the deflecting nozzle N(E), but it is also possible to set a certain prescribed upper limit value UL', regardless of the amount of landing position displacement. In this case, it is possible to save the work of determining a plurality of output density limit LUTs 85*a*, and the ejection correction LUTs 62*a* can be determined in a simpler fashion.

<Example of Composition of Inkjet Recording Apparatus>

Next, an example of the composition of an inkjet recording apparatus which is one example of the printer 12 shown in FIG. 1 will be described.

Figure 16:
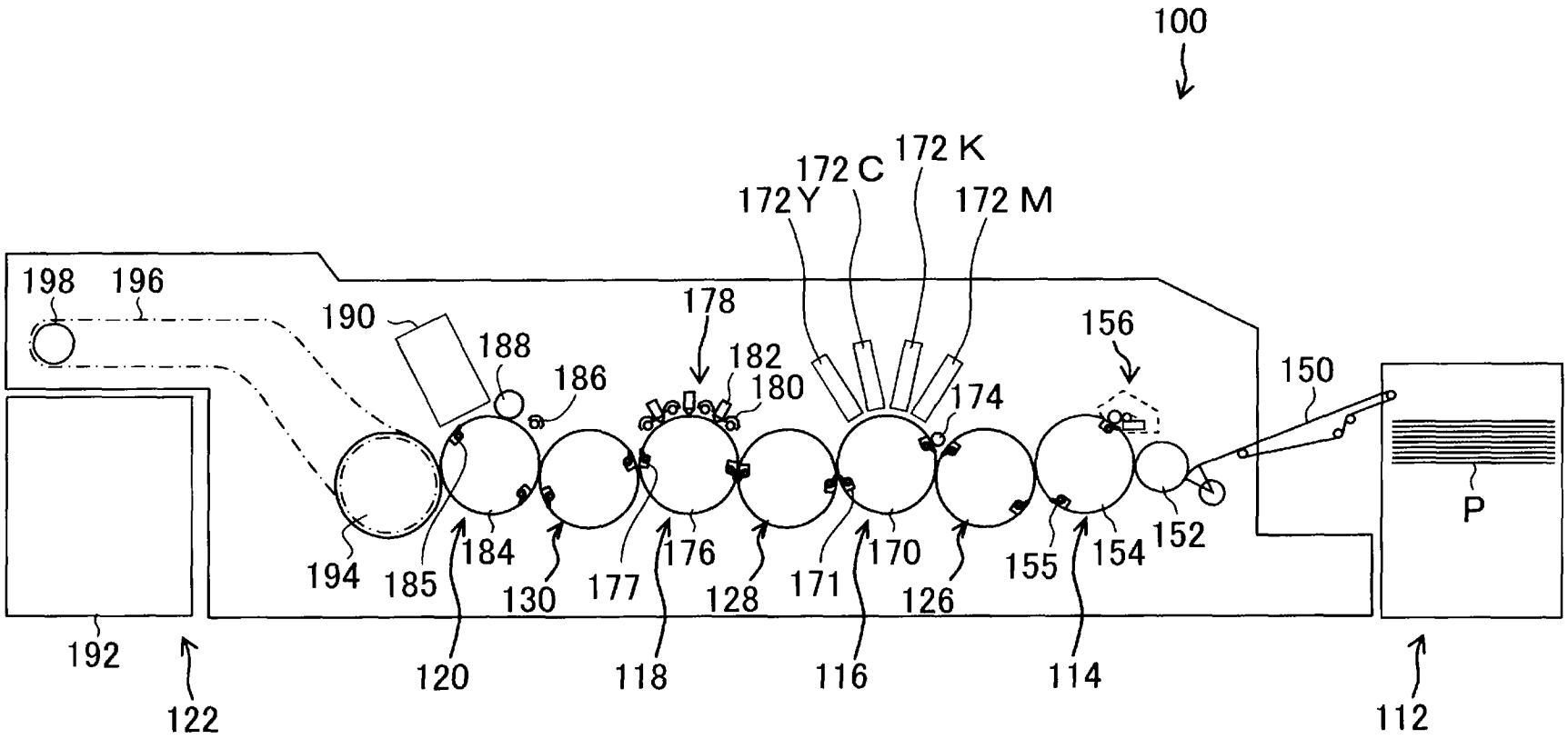
FIG. 16 is a general schematic drawing of an inkjet recording apparatus.

As shown in FIG. 16, the inkjet recording apparatus 100 is an inkjet recording apparatus using a direct image formation method, which forms a desired color image by ejecting droplets of inks of a plurality of colors from long inkjet heads 172M, 172K, 172C and 172Y (corresponding to the inkjet head 27 of the respective embodiments described above) onto a recording medium P (called "paper" below) held on an image formation drum 170. The inkjet recording apparatus 100 is an image forming apparatus of a drop-on-demand type employing a two-liquid reaction (aggregation) method in which an image is formed on a recording medium P by depositing a treatment liquid (here, an aggregating treatment liquid) on a recording medium P before ejecting droplets of ink, and causing the treatment liquid and ink liquid to react together.

The inkjet recording apparatus 100 principally includes a paper feed unit 112, a treatment liquid deposition unit 114, an image formation unit 116, a drying unit 118, a fixing unit 120 and a paper output unit 122.

(Paper Supply Unit)

Recording media P which is cut sheet paper is stacked in the paper supply unit 112. The recording media P is supplied to the treatment liquid deposition unit 114, one sheet at a time, from a paper supply tray 150 of the paper supply unit 112. Cut sheet paper (cut paper) is used as the recording medium P, but it is also possible to adopt a composition in which paper is supplied from a continuous roll (rolled paper) and is cut to the required size.

(Treatment Liquid Deposition Unit)

The treatment liquid deposition unit 114 is a mechanism which deposits treatment liquid onto a recording surface of the recording medium P. The treatment liquid includes a coloring material aggregating agent which aggregates the coloring material (in the present embodiment, the pigment) in the ink deposited by the image formation unit 116, and the separation of the ink into the coloring material and the solvent is promoted due to the treatment liquid and the ink making contact with each other.

The treatment liquid deposition unit 114 includes a paper supply drum 152, a treatment liquid drum 154 and a treatment liquid application apparatus 156. The treatment liquid drum 154 includes a hook-shaped gripping device (gripper) 155 provided on the outer circumferential surface thereof, and is devised in such a manner that the leading end of the recording medium P can be held by gripping the recording medium P between the hook of the holding device 155 and the circumferential surface of the treatment liquid drum 154. The treatment liquid drum 154 may include suction holes provided in the outer circumferential surface thereof, and be connected to a suctioning device which performs suctioning via the suction holes. By this means, it is possible to hold the recording medium P tightly against the circumferential surface of the treatment liquid drum 154.

A treatment liquid application apparatus 156 is arranged opposing the circumferential surface of the treatment liquid drum 154. The treatment liquid application apparatus 156 includes a treatment liquid vessel in which treatment liquid is stored, an anilox roller which is partially immersed in the treatment liquid in the treatment liquid vessel, and a rubber roller which transfers a dosed amount of the treatment liquid to the recording medium P, by being pressed against the anilox roller and the recording medium P on the treatment liquid drum 154. According to this treatment liquid application apparatus 156, it is possible to apply treatment liquid to the recording medium P while dosing the amount of the treatment liquid. In the present embodiment, a composition is described which uses a roller-based application method, but the method is not limited to this, and it is also possible to employ various other methods, such as a spray method, an inkjet method, or the like.

The recording medium P onto which treatment liquid has been deposited is transferred from the treatment liquid drum 154 to the image formation drum 170 of the image formation unit 116 via the intermediate conveyance unit 126.

(Image Formation Unit)

The image formation unit 116 includes an image formation drum 170, a paper pressing roller 174, and inkjet heads 172M, 172K, 172C and 172Y. Similarly to the treatment liquid drum 154, the image formation drum 170 includes a hook-shaped holding device (gripper) 171 on the outer circumferential surface of the drum.

The inkjet heads 172M, 172K, 172C and 172Y are each full-line type inkjet recording heads (inkjet heads) having a length corresponding to the maximum width of the image forming region on the recording medium P, and a nozzle row of nozzles for ejecting ink arranged throughout the whole width of the image forming region is formed in the ink ejection surface of each head. The inkjet heads 172M, 172K, 172Y and 172Y are disposed so as to extend in a direction perpendicular to the conveyance direction of the recording medium P (the direction of rotation of the image formation drum 170).

When droplets of the corresponding colored ink are ejected from the inkjet heads 172M, 172K, 172C and 172Y toward the recording surface of the recording medium P which is held tightly on the image formation drum 170, the ink makes contact with the treatment liquid which has previously been deposited onto the recording surface by the treatment liquid deposition unit 114, the coloring material (pigment) dispersed in the ink is aggregated, and a coloring material aggregate is thereby formed. By this means, flowing of coloring material, and the like, on the recording medium P is prevented and an image is formed on the recording surface of the recording medium P.

In other words, the recording medium P is conveyed at a uniform speed by the image formation drum 170, and it is possible to record an image on an image forming region of the recording medium P by performing just one operation of moving the recording medium P and the respective inkjet heads 172M, 172K, 172C and 172Y relatively in the conveyance direction (in other words, by a single sub-scanning operation).

The recording medium P onto which an image has been formed in the image formation unit 116 is transferred from the image formation drum 170 to the drying drum 176 of the drying unit 118 via the intermediate conveyance unit 128.

(Drying Unit)

The drying unit 118 is a mechanism which dries the water content contained in the solvent which has been separated by the action of aggregating the coloring material, and includes a drying drum 176 and a solvent drying apparatus 178. Similarly to the treatment liquid drum 154, the drying drum 176 includes a hook-shaped holding device (gripper) 177 provided on the outer circumferential surface of the drum, in such a manner that the leading end of the recording medium P can be held by the holding device 177.

The solvent drying apparatus 178 is disposed in a position opposing the outer circumferential surface of the drying drum 176, and is constituted by a plurality of halogen heaters 180 and hot air spraying nozzles 182 disposed respectively between the halogen heaters 180. The recording medium P on which a drying process has been carried out in the drying unit 118 is transferred from the drying drum 176 to the fixing drum 184 of the fixing unit 120 via the intermediate conveyance unit 130.

(Fixing Unit)

The fixing unit 120 is constituted by a fixing drum 184, a halogen heater 186, a fixing roller 188 and an in-line sensor 190. Similarly to the treatment liquid drum 154, the fixing drum 184 includes a hook-shaped holding device (gripper) 185 provided on the outer circumferential surface of the drum, in such a manner that the leading end of the recording medium P can be held by the holding device 185.

By means of the rotation of the fixing drum 184, the recording medium P is conveyed with the recording surface facing to the outer side, and preliminary heating by the halogen heater 186, a fixing process by the fixing roller 188 and inspection by the in-line sensor 190 are carried out in respect of the recording surface.

The fixing roller 188 is a roller member for melting self-dispersing polymer micro-particles contained in the ink and thereby causing the ink to form a film, by applying heat and pressure to the dried ink, and is composed so as to heat and pressurize the recording medium P. More specifically, the fixing roller 188 is disposed so as to press against the fixing drum 184, in such a manner that a nip is created between the fixing roller and the fixing drum 184. The recording medium P is sandwiched between the fixing roller 188 and the fixing drum 184 and is nipped with a prescribed nip pressure, whereby a fixing process is carried out.

Furthermore, the fixing roller 188 is constituted by a heated roller which incorporates a halogen lamp, or the like, and is controlled to a prescribed temperature.

An in-line sensor 190 is a device for reading in an image formed on the recording medium P (including the test charts of the respective embodiments described above, and the like) and determining the density of the image, defects in the image, and so on. A CCD line sensor, or the like, is employed for the in-line sensor 190.

According to the fixing unit 120, the latex particles in the thin image layer formed by the drying unit 118 are heated, pressurized and melted by the fixing roller 188, and hence the image layer can be fixed to the recording medium P. Furthermore, the surface temperature of the fixing drum 184 is set to no less than 50° C. Drying is promoted by heating the recording medium P held on the outer circumferential surface of the fixing drum 184 from the rear surface, and therefore breaking of the image during fixing can be prevented, and furthermore, the strength of the image can be increased by the effects of the increased temperature of the image.

Instead of an ink which includes a high-boiling-point solvent and polymer micro-particles (thermoplastic resin particles), it is also possible to include a monomer which can be polymerized and cured by exposure to UV light. In this case, the inkjet recording apparatus 100 includes a UV exposure unit for exposing the ink on the recording medium P to UV light, instead of a heat and pressure fixing unit (fixing roller 188) based on a heat roller. In this way, if using an ink containing an active light-curable resin, such as a ultraviolet-curable resin, a device which irradiates the active light, such as a UV lamp or an ultraviolet LD (laser diode) array, is provided instead of the fixing roller 188 for heat fixing.

(Paper Output Unit)

A paper output unit 122 is provided subsequently to the fixing unit 120. The paper output unit 122 includes a output tray 192, and a transfer drum 194, a conveyance belt 196 and a tensioning roller 198 are provided between the output tray 192 and the fixing drum 184 of the fixing unit 120 so as to oppose same. The recording medium P is sent to the conveyance belt 196 by the transfer drum 194 and output to the output tray 192. The details of the paper conveyance mechanism created by the conveyance belt 196 are not shown, but the leading end portion of a recording medium P after printing is held by a gripper on a bar (not illustrated) which spans between endless conveyance belts 196, and the recording medium is conveyed about the output tray 192 due to the rotation of the conveyance belts 196.

Furthermore, although not shown in figures, the inkjet recording apparatus 100 according to the present embodiment includes, in addition to the composition described above, an ink storing and loading unit which supplies ink to the inkjet heads 172M, 172K, 172C and 172Y, and a device which supplies treatment liquid to the treatment liquid deposition unit 114, as well as including a head maintenance unit which carries out cleaning (nozzle surface wiping, purging, nozzle suctioning, and the like) of the inkjet heads 172M, 172K, 172C and 172Y, a position determination sensor which determines the position of the recording medium P in the paper conveyance path, a temperature sensor which determines the temperature of the respective units of the apparatus, and the like.

<Structure of Head>

Next, the structure of heads is described. The respective heads 170M, 172K, 172C and 172Y have the same structure, and a reference numeral 250 is hereinafter designated to any of the heads.

Figure 17A:
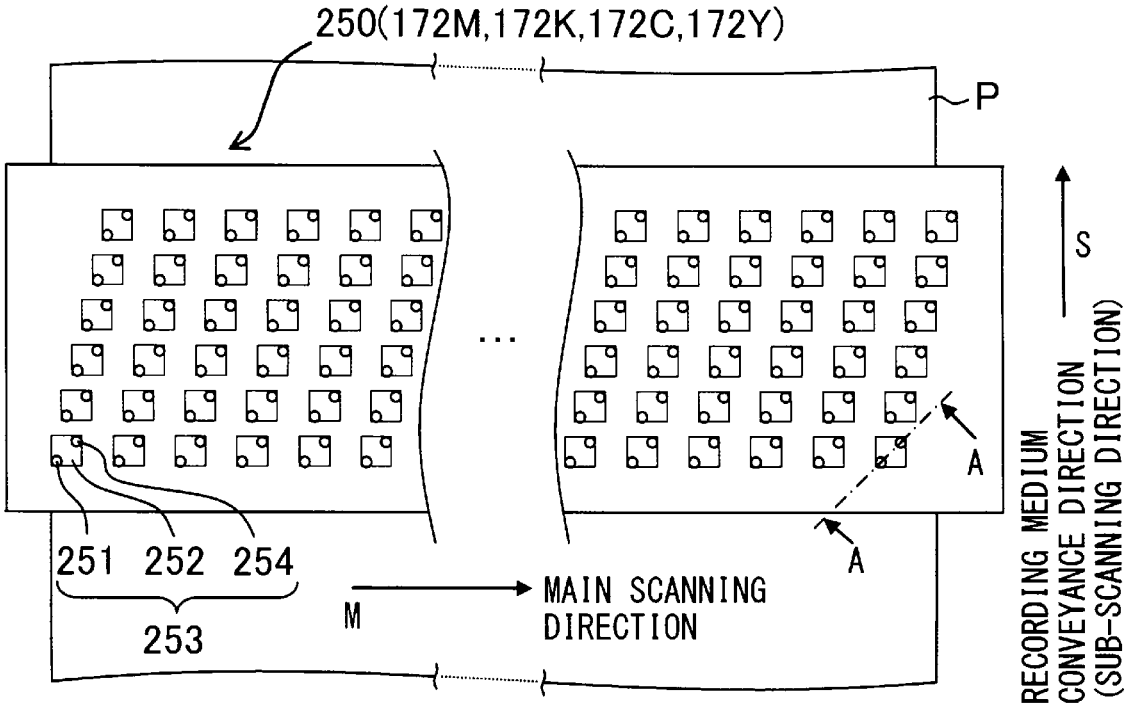
FIG. 17A is a plan view perspective diagram showing an example of a structure of an inkjet head.
Figure 17B:
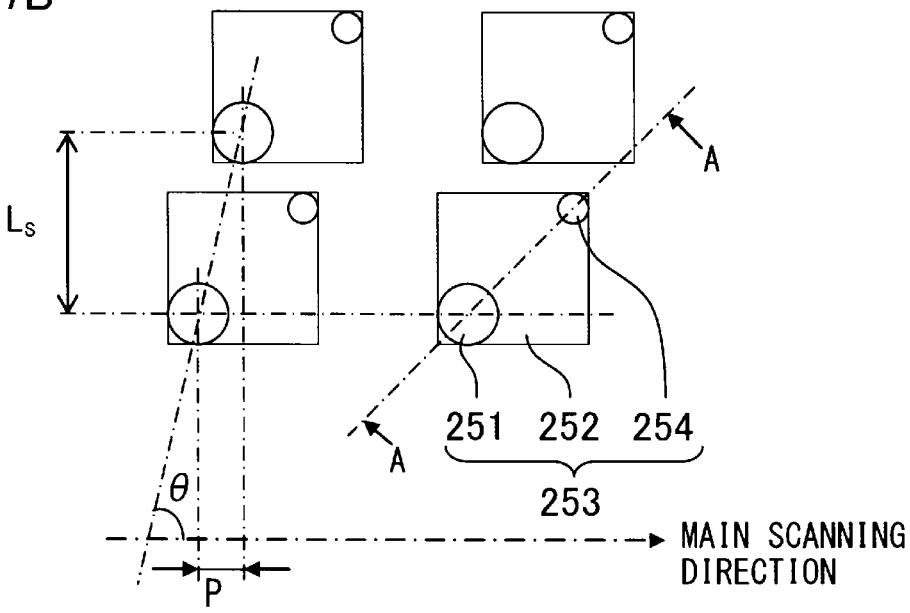
FIG. 17B is an enlarged diagram of a portion thereof.
Figure 18A:
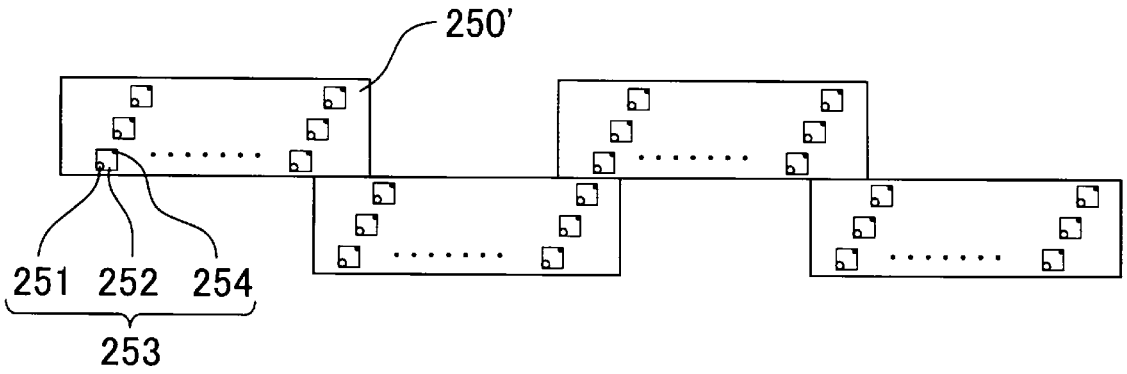
FIGS. 18A and 18B are plan view perspective diagrams showing examples of the structure of a head.
Figure 18B:
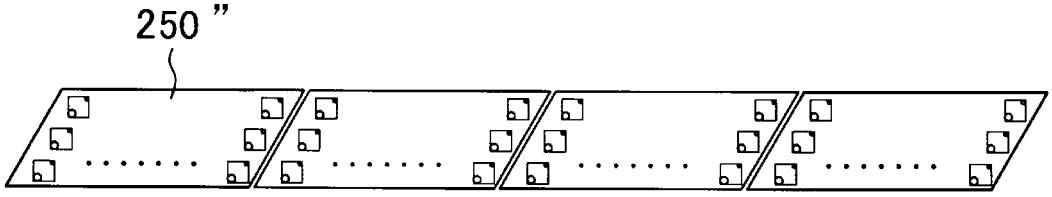
Figure 19:
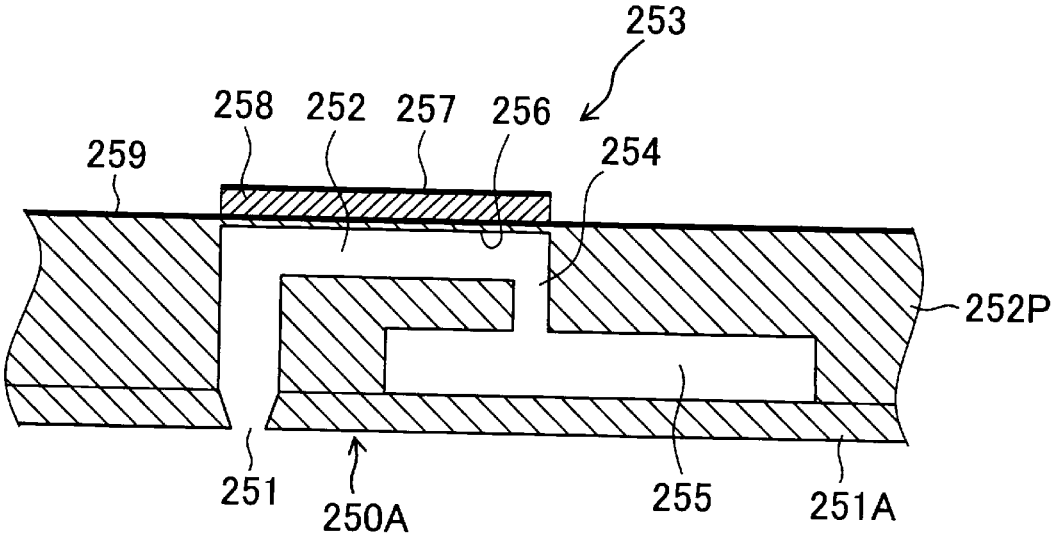
FIG. 19 is a cross-sectional diagram along line A-A in FIG. 17.

FIG. 17A is a plan perspective diagram illustrating an embodiment of the structure of a head 250, and FIG. 17B is a partial enlarged diagram of same. Moreover, FIGS. 18A and 18B are planar perspective views illustrating other structural embodiments of heads 250, and FIG. 19 is a cross-sectional diagram illustrating a liquid droplet ejection element for one channel being a recording element unit (an ink chamber unit corresponding to one nozzle 251) (a cross-sectional diagram along line A-A in FIGS. 17A and 17B).

As illustrated in FIG. 17A, the head 250 according to the present embodiment has a structure in which a plurality of ink chamber units (liquid droplet ejection elements) 253, each having a nozzle 251 forming an ink droplet ejection aperture, a pressure chamber 252 corresponding to the nozzle 251, and the like, are disposed two-dimensionally in the form of a staggered matrix, and hence the effective nozzle interval (the projected nozzle pitch) as projected (orthographically-projected) in the lengthwise direction of the head (the direction perpendicular to the paper conveyance direction) is reduced and high nozzle density is achieved.

The mode of forming nozzle rows which have a length equal to or more than the entire width Wm of the recording area of the recording medium P in a direction (direction indicated by arrow M: main scanning direction) substantially perpendicular to the paper conveyance direction (direction indicated by arrow S: sub-scanning direction) of the recording medium P is not limited to the embodiment described above. For example, instead of the configuration in FIG. 17A, as illustrated in FIG. 18A, a line head having nozzle rows of a length corresponding to the entire width Wm of the recording area of the recording medium P can be formed by arranging and combining, in a staggered matrix, short head modules 250' having a plurality of nozzles 251 arrayed in a two-dimensional fashion. It is also possible to arrange and combine short head modules 250" in a line as shown in FIG. 18B.

The pressure chamber 252 provided to each nozzle 251 has substantially a square planar shape (see FIGS. 17A and 17B), and has an outlet port for the nozzle 251 at one of diagonally opposite corners and an inlet port (supply port) 254 for receiving the supply of the ink at the other of the corners. The planar shape of the pressure chamber 252 is not limited to this embodiment and can be various shapes including quadrangle (rhombus, rectangle, etc.), pentagon, hexagon, other polygons, circle, and ellipse.

As illustrated in FIG. 19, the head 250 is configured by stacking and joining together a nozzle plate 251A, in which the nozzles 251 are formed, a flow channel plate 252P, in which the pressure chambers 252 and the flow channels including the common flow channel 255 are formed, and the like.

The flow channel plate 252P constitutes lateral side wall parts of the pressure chamber 252 and serves as a flow channel formation member, which forms the supply port 254 as a limiting part (the narrowest part) of the individual supply channel leading the ink from a common flow channel 255 to the pressure chamber 252. FIG. 19 is simplified for the convenience of explanation, and the flow channel plate 252P may be structured by stacking one or more substrates.

The nozzle plate 251A and the flow channel plate 252P can be made of silicon and formed in the prescribed shapes by means of the semiconductor manufacturing process.

The common flow channel 255 is connected to an ink tank (not shown), which is a base tank for supplying ink, and the ink supplied from the ink tank is delivered through the common flow channel 255 to the pressure chambers 252.

A piezoelectric actuator 258 having an individual electrode 257 is connected on a diaphragm 256 constituting a part of faces (the ceiling face in FIG. 19) of the pressure chamber 252. The diaphragm 256 in the present embodiment is made of silicon having a nickel (Ni) conductive layer serving as a common electrode 259 corresponding to lower electrodes of a plurality of piezoelectric actuators 258, and also serves as the common electrode of the piezoelectric actuators 258, which are disposed on the respective pressure chambers 252. The diaphragm 256 can be formed by a non-conductive material such as resin; and in this case, a common electrode layer made of a conductive material such as metal is formed on the surface of the diaphragm member. It is also possible that the diaphragm is made of metal (an electrically-conductive material) such as stainless steel (SUS), which also serves as the common electrode.

When a drive voltage is applied between the individual electrode 257 and the common electrode 259, the piezoelectric actuator 258 is deformed, the volume of the pressure chamber 252 is thereby changed, and the pressure in the pressure chamber 252 is thereby changed, so that the ink inside the pressure chamber 252 is ejected through the nozzle 251. When the displacement of the piezoelectric actuator 258 is returned to its original state after the ink is ejected, new ink is refilled in the pressure chamber 252 from the common flow channel 255 through the supply port 254.

As illustrated in FIG. 17B, the plurality of ink chamber units 253 having the above-described structure are arranged in a prescribed matrix arrangement pattern in a line direction along the main scanning direction and a column direction oblique at an angle of θ with respect to the main scanning direction, and thereby the high density nozzle head is formed in the present embodiment. In this matrix arrangement, the nozzles 251 can be regarded to be equivalent to those substantially arranged linearly at a fixed pitch $P=L_s/\tan\theta$ along the main scanning direction, where $L_s$ is a distance between the nozzles adjacent in the sub-scanning direction.

The mode of arrangement of the nozzles 251 in the head 250 is not limited to the embodiments in the drawings, and various nozzle arrangement structures can be employed.

For example, it is also possible to use a single linear arrangement, a V-shaped nozzle arrangement, or an undulating nozzle arrangement, such as zigzag configuration (W-shape arrangement), which repeats units of V-shaped nozzle arrangements.

Action and Beneficial Effects of the Present Embodiment

According to the present embodiment, the output destiny (ejected ink droplet volume) is limited without disabling ejection from the ejection abnormal nozzles, such as deflecting nozzles.

Even in cases where the interval between ink ejected from adjacent nozzles which are adjacent to an ejection abnormality nozzle becomes greater due to landing interference, it is possible to record an image using the ejection abnormality nozzle, and therefore the occurrence of stripe non-uniformities is suppressed.

<Modification Example>

In the embodiment described above, an inkjet recording apparatus based on a method which forms an image by ejecting ink droplets directly onto the recording medium P (direct recording method) was described, but the application of the present invention is not limited to this, and the present invention can also be applied to an image forming apparatus of an intermediate transfer type which provisionally forms an image (primary image) on an intermediate transfer body, and then performs final image formation by transferring the image onto recording paper in a transfer unit.

<Device for Causing Relative Movement of Head and Paper>

In the embodiment described above, an example is given in which a recording medium is conveyed with respect to a stationary inkjet head, but in implementing the present invention, it is also possible to move a head with respect to a stationary recording medium (image formation receiving medium).

<Recording Medium>

"Recording medium" is a general term for a medium on which dots are recorded by droplets ejected from an inkjet head, and this includes various terms, such as print medium, recording medium, image forming medium, image receiving medium ejection receiving medium, and the like. In implementing the present invention, there are no particular restrictions on the material or shape, or other features, of the recording medium, and it is possible to employ various different media, irrespective of their material or shape, such as continuous paper, cut paper, seal paper, OHP sheets or other resin sheets, film, cloth, nonwoven cloth, a printed substrate on which a wiring pattern, or the like, is formed, or a rubber sheet.

<Ejection System>

The devices which generate pressure (ejection energy) applied to eject droplets from the nozzles in the inkjet head is not limited to the piezoelectric actuator (piezoelectric elements), and can employ various pressure generation devices (ejection energy generation devices), such as piezoelectric elements, electrostatic actuators, heaters in a thermal system (which uses the pressure resulting from film boiling by the heat of the heaters to eject ink) and various actuators in other systems. According to the ejection system employed in the head, the corresponding energy generation devices are arranged in the flow channel structure body.

<Examples of Application of Apparatus>

In the respective embodiments described above, application to an inkjet recording apparatus for graphic printing was described, but the scope of application of the present invention is not limited to this example. For example, the present invention can also be applied widely to inkjet apparatuses which obtain various shapes or patterns using liquid function material, such as a wire printing apparatus which forms an image of a wire pattern for an electronic circuit, manufacturing apparatuses for various devices, a resist printing apparatus which uses resin liquid as a functional liquid for ejection, a color filter manufacturing apparatus, a fine structure forming apparatus for forming a fine structure using a material for material deposition, or the like.

In the respective embodiments described above, a case was described in which the output density of the deflecting nozzles N(E) (the ejection ink droplet volume) is limited, but the output density may also be limited similarly for other ejection abnormality nozzles which are capable of ejecting ink. An ejection abnormality nozzle which cannot be used for image recording (for example, an ejection abnormality nozzle having an extremely small ink ejection volume, or an ejection abnormality nozzle which ejects ink intermittently, or the like) may be treated as an ejection failure nozzle.

In the respective embodiments described above, the printing system is provided with an in-line sensor 29 and an abnormal nozzle detection unit 53, but these elements may also be provided separately from the printing system (for example, an external inspection apparatus). In this case, an input interface of the printing system (PC 14, or the like) which inputs the analysis results of the test chart for abnormality nozzle detection (abnormality nozzle detection results) obtained by reading and analyzing with an external inspection apparatus functions as an abnormal nozzle detection device according to the present embodiment.

The present invention is not limited to the embodiments described above, and various modifications can be made within the scope of the technical idea of the invention, by a person having normal knowledge of the field.

<Appendix: Disclosed Modes of the Invention>

As has become evident from the detailed description of the embodiment of the present invention given above, the present specification includes disclosure of various technical ideas including at least the inventions described above.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a recording head having a plurality of nozzles which perform ejection of droplets;

an abnormal nozzle detection device which detects an ejection abnormality nozzle displaying an ejection abnormality, of the plurality of nozzles;

a storage device which stores a correction value which is used in correcting a non-uniformity in an image caused by the ejection abnormality nozzle;

a droplet volume limiting device which limits a droplet volume of droplets ejected from the ejection abnormality nozzle detected by the abnormal nozzle detection device, to not greater than a prescribed upper limit value which is smaller than the droplet volume of the droplets ejected from other normally functioning nozzles apart from the ejection abnormality nozzle;

a droplet volume correction device which corrects a droplet volume of the droplets ejected from normally functioning nozzles, on the basis of the correction value stored in the storage device;

an image recording device which records an image on a recording medium by depositing droplets ejected respectively from the ejection abnormality nozzle and normally functioning nozzles of the recording head, onto the recording medium, while relatively moving the recording head and the recording medium; and a displacement amount determination device which determines an amount of displacement of a landing position of the liquid droplet ejected onto the recording medium from the ejection abnormality nozzle;

wherein the droplet volume correction device increases a droplet volume of the droplets ejected from the normally functioning nozzles which record dots adjacent to the dots corresponding to the ejection abnormality nozzles;

the ejection abnormality nozzle is a deflecting nozzle which produces deflection of the flight of the droplets, the droplet volume limiting device modifies the upper limit value in accordance with a size of the amount of displacement determined by the displacement amount determination device;

the droplet volume correction device modifies the correction amount of the droplet volume of the droplets ejected from the normally functioning nozzles, in accordance with the size of the amount of displacement determined by the displacement amount determination device; and the prescribed upper limit value is an upper limit value set based on reading results of a plurality of test charts for deflecting nozzle correction each of which corresponds to different density correction coefficient.

2. The inkjet recording apparatus as defined in claim 1, wherein the droplet volume limiting device limits the droplet volume of the droplets ejected from the ejection abnormality nozzles, by implementing image processing to image data.

3. The inkjet recording apparatus as defined in claim 1, wherein the plurality of nozzles are capable of selectively ejecting the droplets of a plurality of types having different droplet sizes; and the droplet volume limiting device causes the droplets of the droplet size corresponding to a droplet volume not greater than the upper limit value, to be ejected from the ejection abnormality nozzle.

4. The inkjet recording apparatus as defined in claim 3, wherein the droplet volume limiting device causes the droplets having a smallest droplet size to be ejected from the ejection abnormality nozzle.

5. The inkjet recording apparatus as defined in claim 1, further comprising a head driver which sends drive signals respectively to the plurality of nozzles, wherein the droplet volume limiting device limits a droplet volume of the droplets ejected from the ejection abnormality nozzle to not greater than the upper limit value, by controlling the head driver so as to adjust the drive signal sent to the ejection abnormality nozzle.

6. The inkjet recording apparatus as defined in claim 1, wherein the abnormal nozzle detection device carries out detection of the ejection abnormality nozzle, on the basis of reading results of a test chart constituted by line patterns recorded respectively by each of the plurality of nozzles.

7. The inkjet recording apparatus as defined in claim 1, wherein the recording head is a head based on a single-pass method which records the image by one relative movement of the head with respect to the recording medium.

8. An image recording method executed by an inkjet recording apparatus, the image recording method comprising:

an abnormal nozzle detection step of detecting an ejection abnormality nozzle displaying an ejection abnormality, from a recording head having a plurality of nozzles which perform ejection of droplets;

a droplet volume limiting step of limiting a droplet volume of the droplets ejected from the ejection abnormality nozzle detected in the abnormal nozzle detection step, to not greater than a prescribed upper limit value which is smaller than the droplet volume of the droplets ejected from other normally functioning nozzles apart from the ejection abnormality nozzle;

a droplet volume correcting step of correcting a droplet volume of the droplets ejected from the normally functioning nozzles, on the basis of a previously stored correction value used for correction of a non-uniformity in an image caused by the ejection abnormality nozzle;

an image recording step of recording an image on a recording medium by depositing droplets ejected respectively from the ejection abnormality nozzle and the normally functioning nozzles of the recording head, onto the recording medium, while relatively moving the recording head and the recording medium and a displacement amount determination step of determining an amount of displacement of a landing position of the liquid droplet ejected onto the recording medium from the ejection abnormality nozzle;

wherein the droplet volume correction step increases a droplet volume of the droplets ejected from the normally functioning nozzles which record dots adjacent to the dots corresponding to the ejection abnormality nozzles;

the ejection abnormality nozzle is a deflecting nozzle which produces deflection of the flight of the droplets, the droplet volume limiting step modifies the upper limit value in accordance with a size of the amount of displacement determined by the displacement amount determination step;

the droplet volume correction step modifies the correction amount of the droplet volume of the droplets ejected from the normally functioning nozzles, in accordance with the size of the amount of displacement determined by the displacement amount determination step; and the prescribed upper limit value is an upper limit value set based on reading results of a plurality of test charts for deflecting nozzle correction each of which corresponds to different density correction coefficient.

* * * * *